US008072473B2

(12) United States Patent
Kim et al.

(10) Patent No.: US 8,072,473 B2
(45) Date of Patent: Dec. 6, 2011

(54) GRAY SCALE VOLTAGE GENERATOR, METHOD OF GENERATING GRAY SCALE VOLTAGE AND TRANSMISSIVE AND REFLECTIVE TYPE LIQUID CRYSTAL DISPLAY DEVICE USING THE SAME

(75) Inventors: Sang-Il Kim, Suwon-si (KR); Cheol-Woo Park, Suwon-si (KR); Tae-Hwan Kim, Seoul (KR); Dong-Sik Sakong, Seongnam-si (KR); Young-Chol Yang, Gunpo-si (KR); Won-Sang Park, Yongin-si (KR); Jae-Chang Kim, Busan-si (KR)

(73) Assignee: Samsung Electronics Co., Ltd. (KR)

( * ) Notice: Subject to any disclaimer, the term of this patent is extended or adjusted under 35 U.S.C. 154(b) by 863 days.

(21) Appl. No.: 11/523,142

(22) Filed: Sep. 19, 2006

(65) Prior Publication Data

US 2007/0013628 A1 Jan. 18, 2007

Related U.S. Application Data

(62) Division of application No. 10/434,645, filed on May 9, 2003, now Pat. No. 7,145,580.

(30) Foreign Application Priority Data

May 9, 2002 (KR) ..... 2002-25539
Mar. 19, 2003 (KR) ..... 2003-16992

(51) Int. Cl.
*G09G 3/36* (2006.01)

(52) U.S. Cl. ..... 345/690; 345/691; 345/692

(58) Field of Classification Search ..... 345/204, 345/690–699, 208–215
See application file for complete search history.

(56) References Cited

U.S. PATENT DOCUMENTS

| | | | | |
|---|---|---|---|---|
| 5,863,458 | A * | 1/1999 | Miyata et al. | 252/299.01 |
| 6,067,062 | A * | 5/2000 | Takasu et al. | 345/87 |
| 6,236,385 | B1 * | 5/2001 | Nomura et al. | 345/95 |
| 6,462,724 | B1 * | 10/2002 | Ozawa et al. | 345/87 |
| 6,771,327 | B2 * | 8/2004 | Sekiguchi | 349/12 |
| 2001/0005192 | A1 * | 6/2001 | Walton et al. | 345/87 |
| 2001/0021107 | A1 * | 9/2001 | Funamoto et al. | 362/84 |

FOREIGN PATENT DOCUMENTS

CN 1220405 6/1999

(Continued)

OTHER PUBLICATIONS

Chinese Office Action Jun. 22, 2007.

*Primary Examiner* — Tammy Pham
(74) *Attorney, Agent, or Firm* — Cantor Colburn LLP

(57) ABSTRACT

A gray scale voltage generator and a method of generating a gray scale voltage in a transmissive and reflective type liquid crystal display device are disclosed. A transmissive mode gray scale data are transformed into real reflective mode gray scale data. An integer part is extracted from the real reflective mode gray scale data as a first reflective mode gray scale data. The first reflective mode gray scale data and temporary reflective mode gray scale data are mixed in a predetermined ratio by N-frame period. The temporary reflective mode gray scale data has a sum of one and the first reflective mode gray scale data. Pseudo gray scale data are inserted into the second reflective mode gray scale data. Therefore, superior display quality is provided in both transmissive and reflective mode.

12 Claims, 27 Drawing Sheets

FOREIGN PATENT DOCUMENTS

| | | | |
|---|---|---|---|
| CN | 1240273 | | 1/2000 |
| JP | 08-272338 | A | 10/1996 |
| JP | 11-015444 | A | 1/1999 |
| JP | 2000-193936 | | 7/2000 |
| JP | 2000-193936 | A | 7/2000 |
| JP | 2002-341342 | | 11/2002 |
| KR | 2003-0087686 | | 11/2003 |

* cited by examiner

FIG. 15

| T MODE GRAY SCALE DATA Gn(T) | Gn(T)X0.75 | OFFSET(y) | REAL R MODE GRAY SCALE DATA Gn(R) |
|---|---|---|---|
| 0 | 0 | 0 | 0 |
| 1 | 0.75 | 0 | 0.75 |
| 2 | 1.5 | 0 | 1.5 |
| 3 | 2.25 | -1 | 2.0 |
| 4 | 3.0 | 0 | 3.0 |
| 5 | 3.75 | -1 | 3.5 |
| 6 | 4.5 | 0 | 4.5 |
| 7 | 5.25 | 0 | 5.25 |
| 8 | 6.0 | -1 | 5.75 |
| . | . | . | . |
| . | . | . | . |
| . | . | . | . |
| 63 | 47.25 | 0 | 47.25 |

FIG. 17

| d | | Vc | | 2ND R MODE |
|---|---|---|---|---|
| $d_1$ | $d_0$ | $V_{c1}$ | $V_{c0}$ | GRAY SCALE DATA |
| 0 | 0 | 0 | 0 | D |
| 0 | 0 | 0 | 1 | D |
| 0 | 0 | 1 | 0 | D |
| 0 | 0 | 1 | 1 | D |
| 0 | 1 | 0 | 0 | D |
| 0 | 1 | 0 | 1 | D |
| 0 | 1 | 1 | 0 | D |
| 0 | 1 | 1 | 1 | D+1 |
| 1 | 0 | 0 | 0 | D |
| 1 | 0 | 0 | 1 | D |
| 1 | 0 | 1 | 0 | D+1 |
| 1 | 0 | 1 | 1 | D+1 |
| 1 | 1 | 0 | 0 | D |
| 1 | 1 | 0 | 1 | D+1 |
| 1 | 1 | 1 | 0 | D+1 |
| 1 | 1 | 1 | 1 | D+1 |

| Vc \ d | 0 | 1 | 2 | 3 |
|---|---|---|---|---|
| 0 | D | D | D | D |
| 1 | D | D | D | D+1 |
| 2 | D | D | D+1 | D+1 |
| 3 | D | D+1 | D+1 | D+1 |

FIG.21

| T MODE GRAY SCALE DATA Gn(T) | LOOKUP TABLE VALUE |
|---|---|
| 0 | 0 |
| 1 | 0.7 |
| 2 | 1.43 |
| 3 | 2.12 |
| 4 | 2.76 |
| 5 | 3.52 |
| 6 | 4.33 |
| 7 | 5.05 |
| 8 | 5.72 |
| ⋮ | ⋮ |
| 63 | 47.0 |

GRAY SCALE VOLTAGE GENERATOR, METHOD OF GENERATING GRAY SCALE VOLTAGE AND TRANSMISSIVE AND REFLECTIVE TYPE LIQUID CRYSTAL DISPLAY DEVICE USING THE SAME

CROSS-REFERENCE TO RELATED APPLICATIONS

This application is a divisional application of U.S. application Ser. No. 10/434,645 filed May 9, 2003, now U.S. Pat. No. 7,145,580 which claims priority to and the benefit of Korean Patent Applications No. 2002-25539 filed on May 9, 2002and P2003-16992 filed on Mar. 19, 2003, the contents of which are herein incorporated by reference in their entirety.

BACKGROUND OF THE INVENTION

1. Field of the Invention

The disclosure relates to a gray scale voltage generator, a method of generating a gray scale voltage and a transmissive and reflective type liquid crystal display device using the same.

2. Description of the Related Art

The liquid crystal display (LCD) device includes a lower substrate (or thin film transistor substrate), an upper substrate (color filter substrate) and a liquid crystal layer interposed between the lower and upper substrates. A common electrode and color filters are formed on the upper substrate. Thin film transistors and pixel electrodes are formed on the lower substrate. A voltage is applied to the lower and upper substrates, an electric field is formed between the lower and upper substrates, the alignment angle of liquid crystal molecules is changed, the transmissivity of the liquid crystal layer is regulated, and thus an image is displayed.

The liquid crystal display device is divided into a transmissive type liquid crystal display device and a reflective liquid crystal display device whether or not the liquid crystal display device employs a light source such as a backlight. A transmissive-and-reflective type liquid crystal display device is operated both in a transmissive mode and in a reflective mode.

Since optical characteristic of the conventional transmissive-and-reflective type liquid crystal display device vary according to the transmissive or reflective modes, when the conventional transmissive-and-reflective type liquid crystal display device has a superior optical characteristics in a transmissive mode, the conventional transmissive-and-reflective type liquid crystal display device has a inferior optical characteristics in a reflective mode, and vice versa.

When the cell gap of the liquid crystal layer and the twist angle of the liquid crystal molecules is fixed so as to provide an optimized transmissivity and contrast ratio in the transmissive mode, the liquid crystal display device provides an inferior reflectivity and contrast ratio in the reflective mode such that the liquid crystal display device may not provide a satisfactory display quality.

In addition, the voltage-transmissivity (V-T) curve and voltage-reflectivity (V-R) curve depending on voltage shows different characteristics according to the mode such as transmissive mode or the reflectivity mode. Accordingly, when the liquid crystal display device employs a same gray scale voltage generating circuit both in the reflective mode and in the transmissive mode, the display quality of the liquid crystal display device may be deteriorated.

SUMMARY OF THE INVENTION

Accordingly, the present invention is provided to substantially obviate one or more problems due to limitations and disadvantages of the related art.

It is one aspect of the present invention to provide a method of generating a gray scale voltage in which transmissive mode gray scale data are transformed into reflective mode gray scale data based on the difference between the luminance characteristic depending on the voltage applied to the liquid crystal layer in the transmissive mode and the luminance characteristic in the reflective mode.

It is another aspect of the present invention to provide a gray scale generator in which transmissive mode gray scale data are transformed into reflective mode gray scale data based on the difference between the luminance characteristic depending on the voltage applied to the liquid crystal layer in the transmissive mode and the luminance characteristic in the reflective mode.

It is further another aspect of the present invention to provide a gray scale generator for generating different gray scale voltages depending on the transmissive mode or the reflective mode.

It is still another aspect of the present invention to provide a liquid crystal display device having a gray scale generator in which transmissive mode gray scale data are transformed into reflective mode gray scale data based on the difference between the luminance characteristic depending on the voltage applied to the liquid crystal layer in the transmissive mode and the luminance characteristic in the reflective mode.

It is still another aspect of the present invention to provide a liquid crystal display device having a gray scale generator for generating different gray scale voltages depending on the transmissive mode or the reflective mode.

It is still another aspect of the present invention to provide a liquid crystal display device having superior display characteristics in both transmissive and reflective modes.

In one aspect of the present invention, there is provided a method of providing a transmissive-and-reflective type liquid crystal display device with a gray scale voltage. Real reflective mode gray scale data corresponding to a first effective range of a reflective mode gray scale voltage are produced using a relation between a second effective range of a transmissive mode gray scale voltage and the transmissive mode gray scale data. An integer part are extracted from the real reflective mode gray scale data so as to produce first reflective mode gray scale data. The first reflective mode gray scale data and temporary reflective mode gray scale data are mixed in a predetermined ratio by N-frame period so as to produce second reflective mode gray scale data. The temporary reflective mode gray scale data has a sum of a first integer and the first reflective mode gray scale data. Pseudo gray scale data are inserted into the second reflective mode gray scale data so as to produce a third reflective mode gray scale data. A first number of the pseudo gray scale data are difference between a second number of a transmissive mode gray scale level and a third number of a reflective mode gray scale level. A transmissive mode gray scale voltage corresponding to the transmissive mode gray scale data are provided to the transmissive and reflective type liquid crystal display device when the transmissive and reflective type liquid crystal display device operates in a transmissive mode. A reflective mode gray scale voltage corresponding to the third reflective mode gray scale data are provided to the transmissive and reflective type liquid crystal display device when the transmissive and reflective type liquid crystal display device operates in a reflective mode.

In another aspect of the present invention, there is provided a gray scale voltage generator for providing a gray scale voltage to a transmissive and reflective type liquid crystal display device. The gray scale voltage generator includes a first reflective mode gray scale data generating means, a frame counter, a second reflective mode gray scale data generating means, a third reflective mode gray scale data generating means, a mode judging means and a selecting means. The first reflective mode gray scale data generating means receives transmissive mode gray scale data, produces real reflective mode gray scale data corresponding to a first effective range of a reflective mode gray scale voltage using a relation between a second effective range of a transmissive mode gray scale voltage and the transmissive mode gray scale data, extracts an integer part from the real reflective mode gray scale data to produce first reflective mode gray scale data, and generates a control datum corresponding to a first figure below a decimal-point of each of the real reflective mode gray scale data. The frame counter receives a frame synchronization signal indicating a beginning of each of the N frames and counts the frame synchronization signal to produce a frame count value. The second reflective mode gray scale data generating means mixes the first reflective mode gray scale data and temporary reflective mode gray scale data in a predetermined ratio by N-frame period to produce second reflective mode gray scale data. The temporary reflective mode gray scale data has a sum of a first integer and the first reflective mode gray scale data. The third reflective mode gray scale data generating means inserts pseudo gray scale data into the second reflective mode gray scale data to produce a third reflective mode gray scale data. A first number of the pseudo gray scale data is a difference between a second number of a transmissive mode gray scale level and a third number of a reflective mode gray scale level. The mode judging means determines one of a transmissive mode or a reflective mode to output a mode determining signal. The selecting means provides the transmissive and reflective type liquid crystal display device with a transmissive mode gray scale data corresponding to the transmissive mode gray scale data when the mode determining signal represents the transmissive mode, and provides the transmissive and reflective type liquid crystal display device with a reflective mode gray scale data corresponding to the third reflective mode gray scale data when the mode determining signal represents the reflective mode.

In still another aspect of the present invention, there is provided a gray scale voltage generator for providing a gray scale voltage to a transmissive and reflective type liquid crystal display device. The liquid crystal display device includes a data driver for applying the gray scale voltage to pixels and a gate driver for controlling switching devices of the pixels and a light source, the gray scale voltage generator includes a controller, a gamma reference voltage generator and a common voltage generator. The controller provides the liquid crystal display device with a transmissive mode gray scale data when the light source is turned on, and provides the liquid crystal display device with a reflective mode gray scale data when the light source is turned off. The gamma reference voltage generator generates a gamma reference voltage based on the transmissive mode gray scale data and the reflective mode gray scale data to output the gamma reference voltage to the data driver. The common voltage generator generates a common voltage to output the common voltage to a common line connected to the pixels.

In still another aspect of the present invention, there is provided a gray scale voltage generator for providing a gray scale voltage to a transmissive and reflective type liquid crystal display device. The liquid crystal display device includes a data driver for applying the gray scale voltage to pixels and a gate driver for controlling switching devices of the pixels and a light source. The gray scale voltage generator includes a controller, a gamma reference voltage generator and a common voltage generator. The controller provides the liquid crystal display device with a transmissive mode selecting signal when the light source is turned on, and provides the liquid crystal display device with a reflective mode selecting signal when the light source is turned off. The gamma reference voltage generator generates a transmissive mode gamma reference voltage and a reflective mode gamma reference voltage based on the transmissive mode selecting signal and the reflective mode selecting signal, respectively, to the data driver. The common voltage generator generates a common voltage to output the common voltage in response to the transmissive and reflective mode selecting signals to a common line connected to the pixels. The common voltage has a transmissive mode common voltage corresponding to a transmissive mode and a reflective mode common voltage corresponding to a reflective mode.

In still another aspect of the present invention, there is provided a liquid crystal display device including a first insulation substrate, first and second wirings, a transparent electrode, a reflective electrode, a first thin film transistor substrate, a second insulation substrate, a common electrode and a liquid crystal layer. The first wiring is formed on the first insulation substrate and extended in a first direction. The second wiring is formed on the first insulation substrate and extended in a second direction to be insulated from the first wiring. The second direction is substantially perpendicular to the first direction. The transparent electrode is formed in at least one pixel region, and the pixel region is defined by the first and second wiring. The reflective electrode is disposed in the at least one pixel region and having an opening. The first thin film transistor substrate is connected to the first wiring, the second wiring, the transparent electrode and the reflective electrode. The second insulation substrate faces the first insulation substrate, and the common electrode is formed on the second insulation substrate. The liquid crystal layer is interposed between the first and second insulation substrate. The major axis of each of liquid crystal molecules of the liquid crystal layer may be twisted in a predetermined angle with respect to the first insulation substrate toward the second insulation substrate, and the predetermined angle may be in a range from about 0° to about 50°.

In addition, the major axis of each of liquid crystal molecules of the liquid crystal layer may be twisted in a substantially perpendicular to the first and second insulation substrates. The liquid crystal layer may be comprised of a chiral dopant so that the ratio of a cell gap to a pitch of the liquid crystal layer may be in a range from about 0 to about 0.15.

As mentioned above, the transmissive and reflective type liquid crystal display device includes the liquid crystal layer that has predetermined twist angle, predetermined amount of chiral dopant and predetermined cell gap, to thereby provide superior display quality in both transmissive and reflective mode.

In addition, according to the gray scale generator and method of generating a gray scale voltage of the present invention, common voltage and gamma reference voltage optimized for each of the transmissive mode and reflective mode are applied to the transmissive and reflective type liquid crystal display device, to thereby provide superior display quality in both transmissive and reflective mode.

In addition, according to the gray scale generator and method of generating a gray scale voltage of the present invention, even when a common voltage and a gamma reference voltage for both transmissive mode and reflective mode, transmissive mode gray scale data are transformed into reflective mode gray scale data based on the difference between the luminance characteristic depending on the voltage applied to the liquid crystal layer in the transmissive mode and the luminance characteristic in the reflective mode, to thereby provide superior display quality in both transmissive and reflective mode.

In addition, the common voltage and gamma reference voltage optimized for each of the transmissive mode and reflective mode are applied to the liquid crystal display device that includes the liquid crystal layer having predetermined twist angle, predetermined amount of chiral dopant and predetermined cell gap of the present invention, to thereby provide superior display quality in both transmissive and reflective mode.

In addition, a common voltage and a gamma reference voltage for both transmissive mode and reflective mode are applied to the liquid crystal display device that includes the liquid crystal layer having predetermined twist angle, predetermined amount of chiral dopant and predetermined cell gap of the present invention, to thereby provide superior display quality in both transmissive and reflective mode.

BRIEF DESCRIPTION OF THE DRAWINGS

The above and other features and advantages of the present invention will become more apparent by describing in detail the preferred embodiments thereof with reference to the accompanying drawings, in which:

FIG. 15 is a table showing a real reflective mode gray scale data produced by a first reflective mode gray scale data generating section;

FIG. 17 is a table showing an output of the multiplex of FIG. 16 depending values of selecting terminal of the multiplex;

FIG. 21 is a table showing a first reflective mode gray scale data stored in a first reflective mode gray scale data storing section;

DESCRIPTION OF THE PREFERRED EMBODIMENTS

Hereinafter the preferred embodiments of the present invention will be described in detail with reference to the accompanying drawings.

Figure 1:
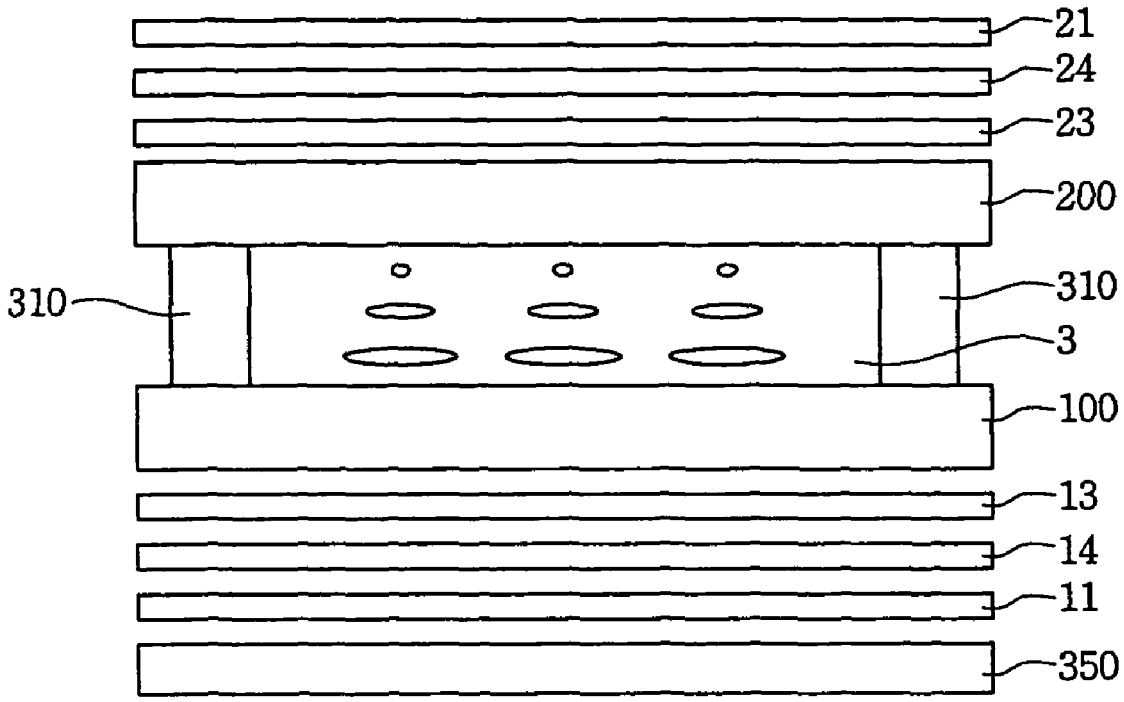
FIG. 1 is a cross-sectional view showing a liquid crystal display panel according to a first exemplary embodiment of the present invention.

FIG. 1 is a cross-sectional view showing a liquid crystal display panel according to a first exemplary embodiment of the present invention.

Referring to FIG. 1, the liquid crystal display device according to a first exemplary embodiment of the present invention includes a thin film transistor substrate 100, a color filter substrate 200 facing the thin film transistor substrate 100, a liquid crystal layer interposed between the thin film transistor substrate 100 and the color filter substrate 200, lower compensation films 13 and 14 attached to a lower surface of the thin film transistor substrate, upper compensation films 23 and 24 attached to an upper surface of the color filter substrate 200, a lower polarizing plate 11 disposed on a lower surface of a second lower compensation film 14, an upper polarizing plate 21 disposed on a upper surface of a second upper compensation film 24, and a backlight assembly 350 disposed below the lower polarizing plate 11.

The liquid crystal molecules of the liquid crystal layer 3 are homogeneously aligned. Namely, the liquid crystal molecules of the liquid crystal layer 3 are twisted in predetermined angles with respect to the thin film transistor substrate 100 toward the color filter substrate 200. The twist angles of the liquid crystal molecules may be in a range from about 0° to 50°. The Δnd of the liquid crystal layer may be in a range from about 0.15 to about 0.35(n: refraction index, d: cell gap). The liquid crystal layer 3 is sealed by sealant 310 between the thin film transistor substrate 100 and the color filter substrate 200.

The polarizing axis of the upper polarizing plate 21 is perpendicular to the polarizing axis of the lower polarizing plate 11. The compensation films 13, 14, 23 and 24 may use λ/4 or λ/2 reciprocal dispersion retardation film. The compensation films 13, 14, 23 and 24 also may be λ/4 or λ/2 normal dispersion retardation film. The lower compensation film may use only a λ/4 retardation film attached to the lower surface of the thin film transistor substrate 100, and the upper compensation film may use only a λ/4 retardation film attached to the upper surface of the color filter substrate 200.

When only λ/4 retardation films are used, the retardation axis of the retardation film may be arranged to form an angle of 45° with respect to the polarization axis of the polarizing plate. The retardation axis of a TAC film supporting the polarizing plate may be arranged to form an angle of about 90° with respect to the polarization axis of the polarizing plate.

A transparent electrode and reflection electrode are formed in each of pixels of the thin film transistor substrate 100. The reflection electrode has an opening for passing light therethrough. Accordingly, the transmissive and reflective modes may be provided. A backlight is turned off in a reflective mode, and the backlight is turned on in a transmissive mode. A data driver applies different gray scale voltages according to a transmissive mode or a reflective mode when the backlight is turned on or off. Two kinds of reference gamma resistor arrays may be used so as to apply different gray scale voltages according to the transmissive mode or the reflective mode. In addition, the bits for representing transmissive mode gray scale data may be different from the bits for representing reflective mode gray scale data so as to apply different gray scale voltages according to the transmissive mode or the reflective mode. The transmissive mode gray scale data having m1 bits may be transformed into the reflective mode gray scale data having m2 bits. (m1 and m2 are natural numbers, and m2 is less than m1) by a frame rate control method.

Figure 2:
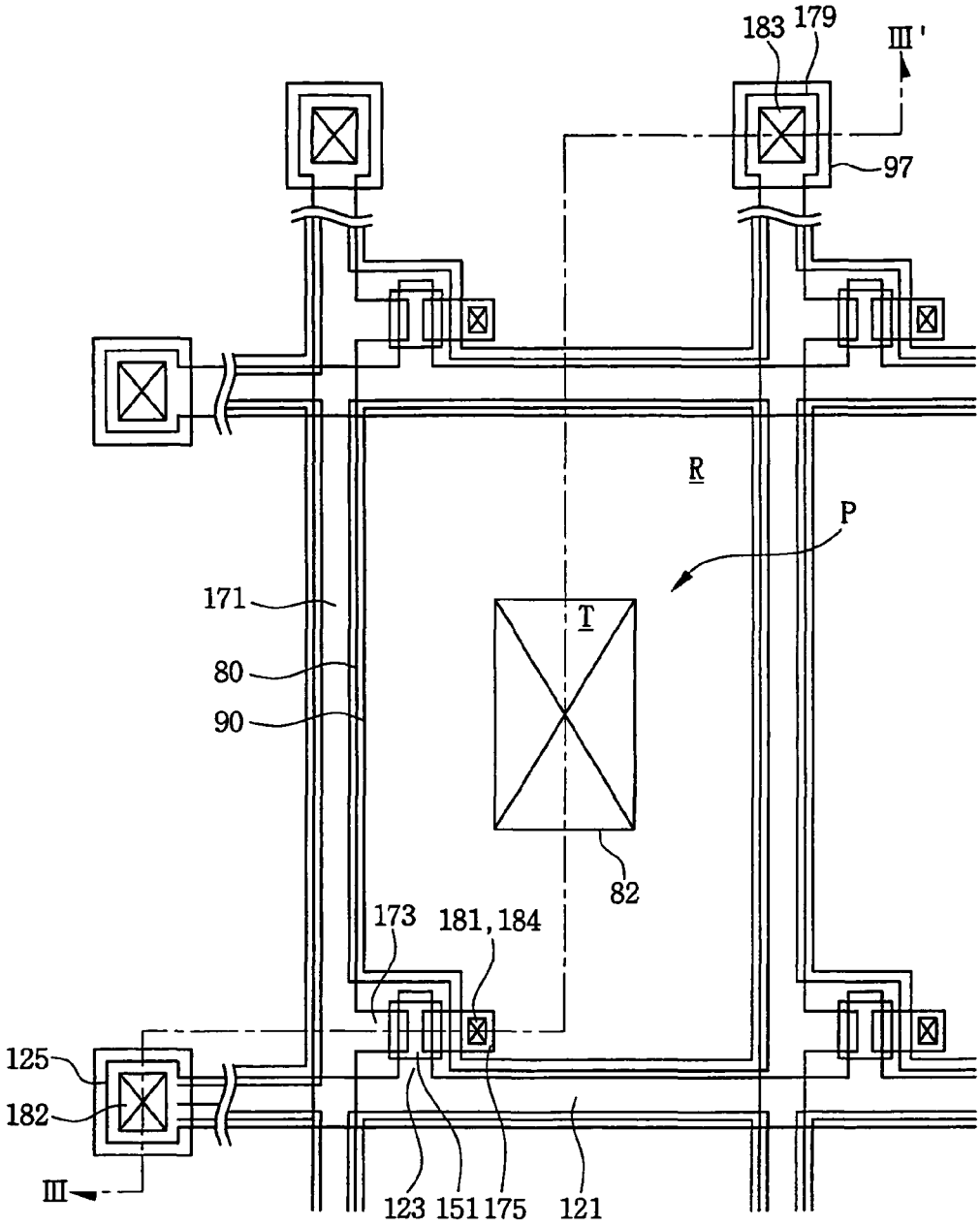
FIG. 2 is a layout showing a thin film transistor substrate of FIG. 1.
Figure 3:
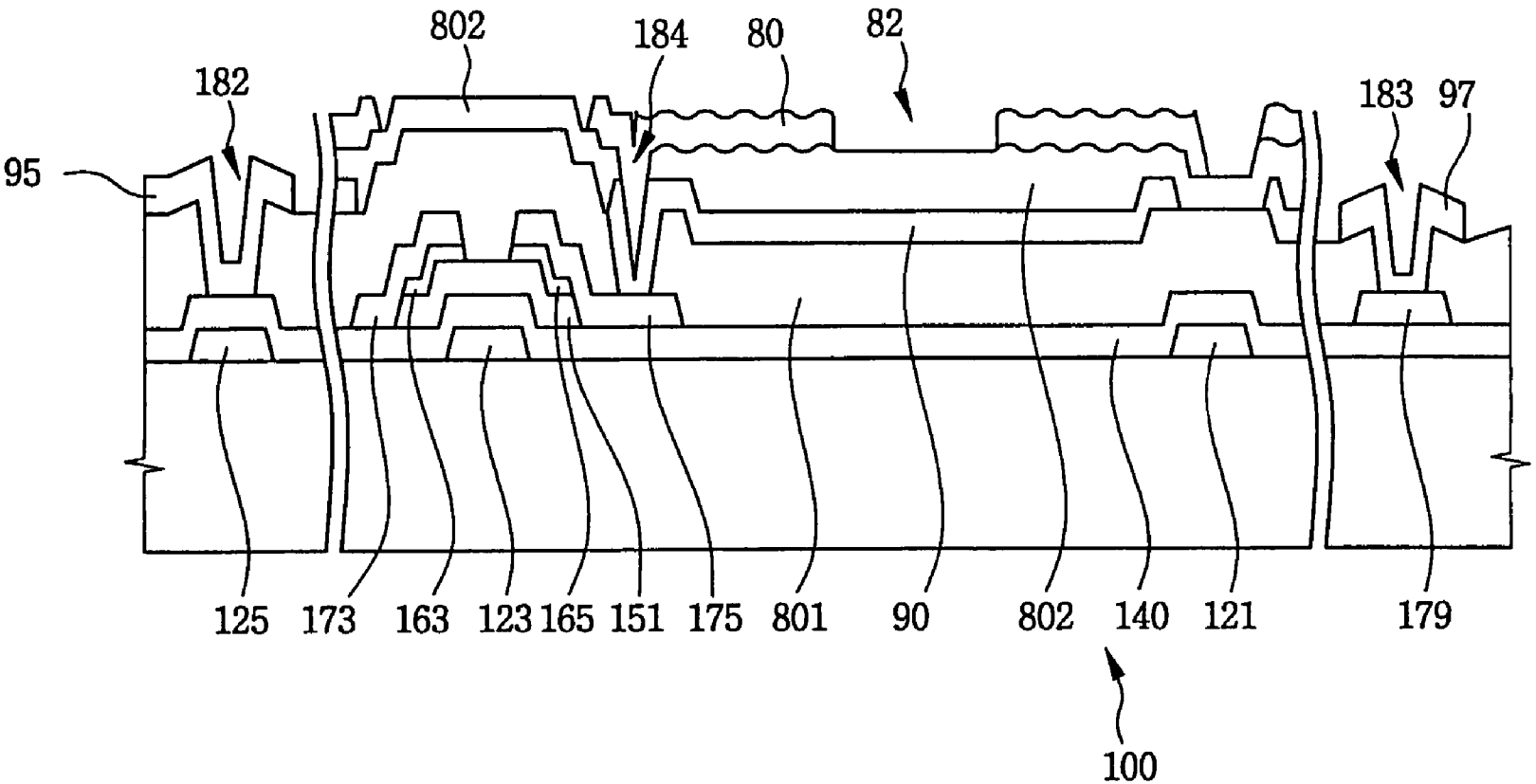
FIG. 3 is a cross-sectional view cut along a lien III-III' of FIG. 2.
Figure 4A:
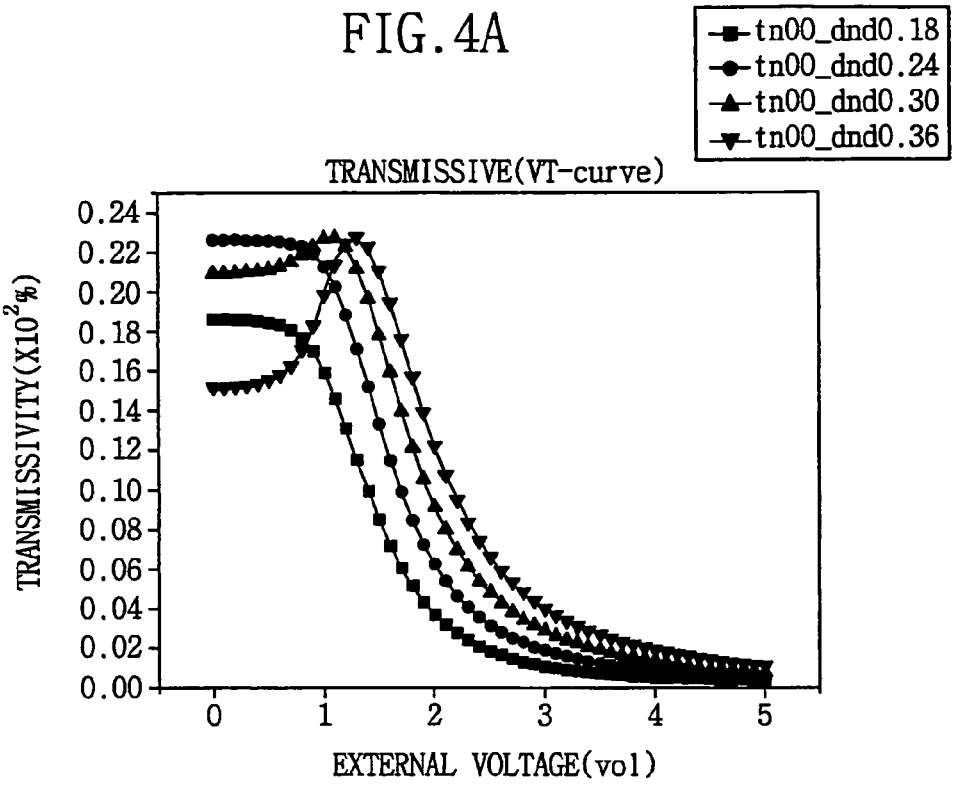
FIGS. 4A, 4B, 4C, 4D and 4E are graphs showing V-T curves depending on twist angles and Δnd of liquid crystal molecules in TN mode according to the first exemplary embodiment of the present invention.
Figure 4B:
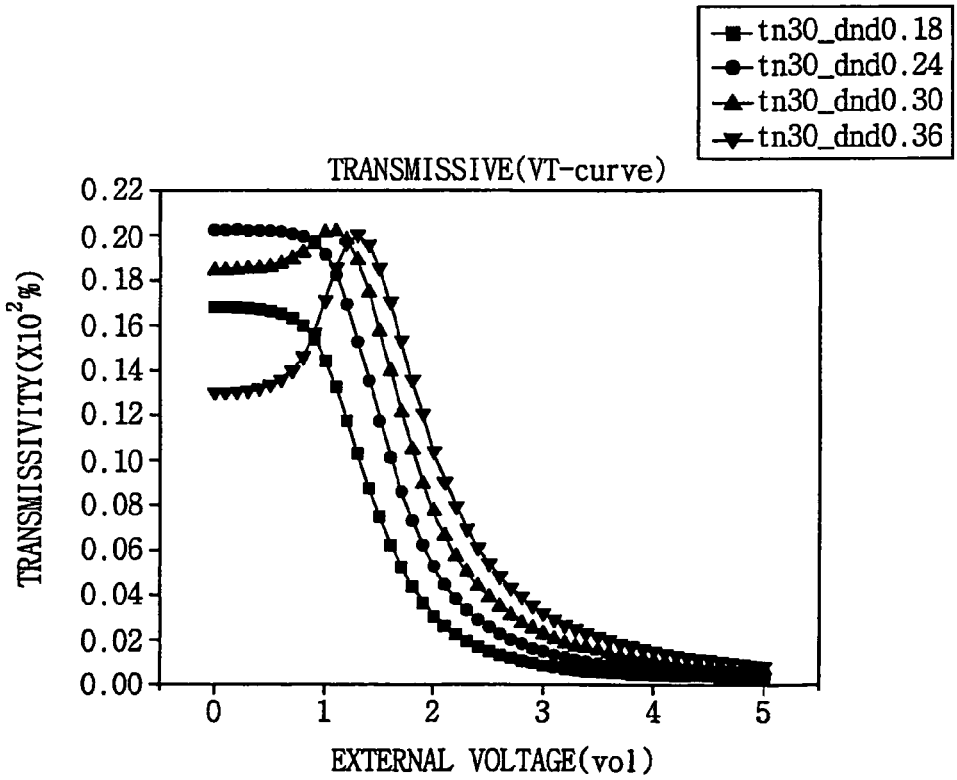
Figure 4C:
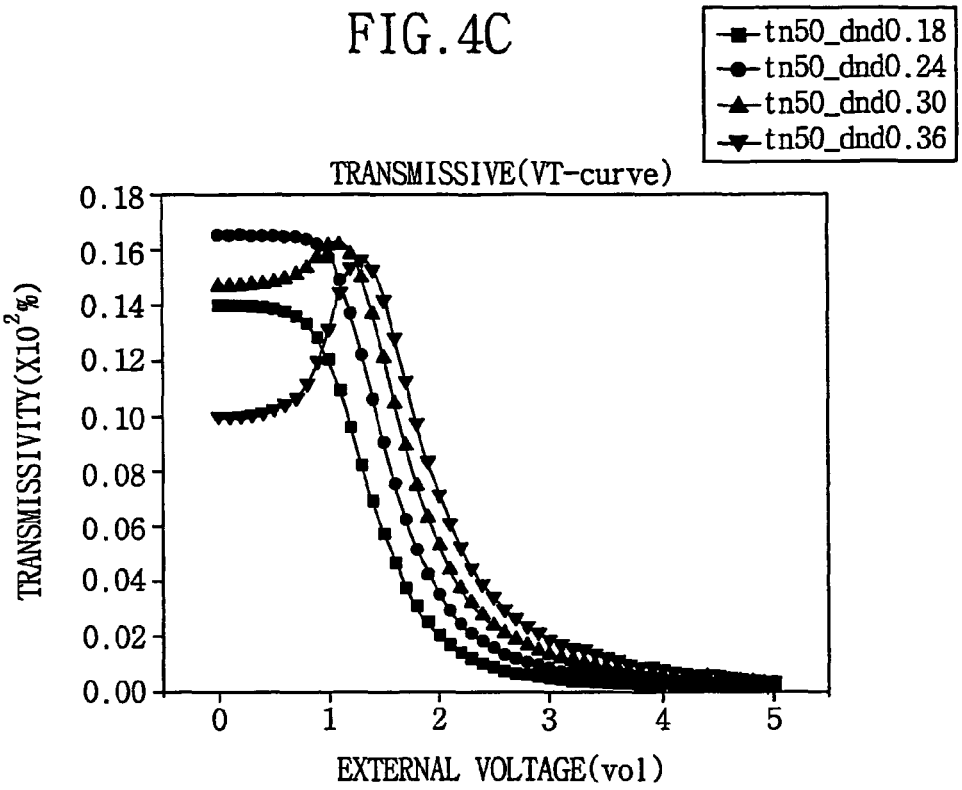
Figure 4D:
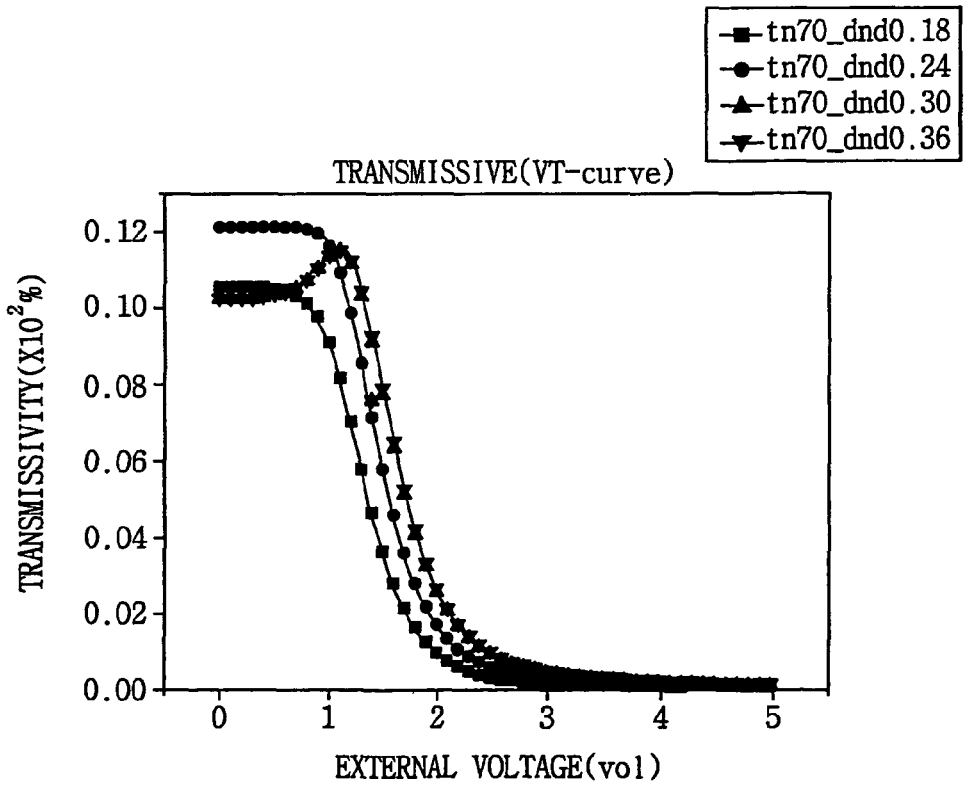
Figure 4E:
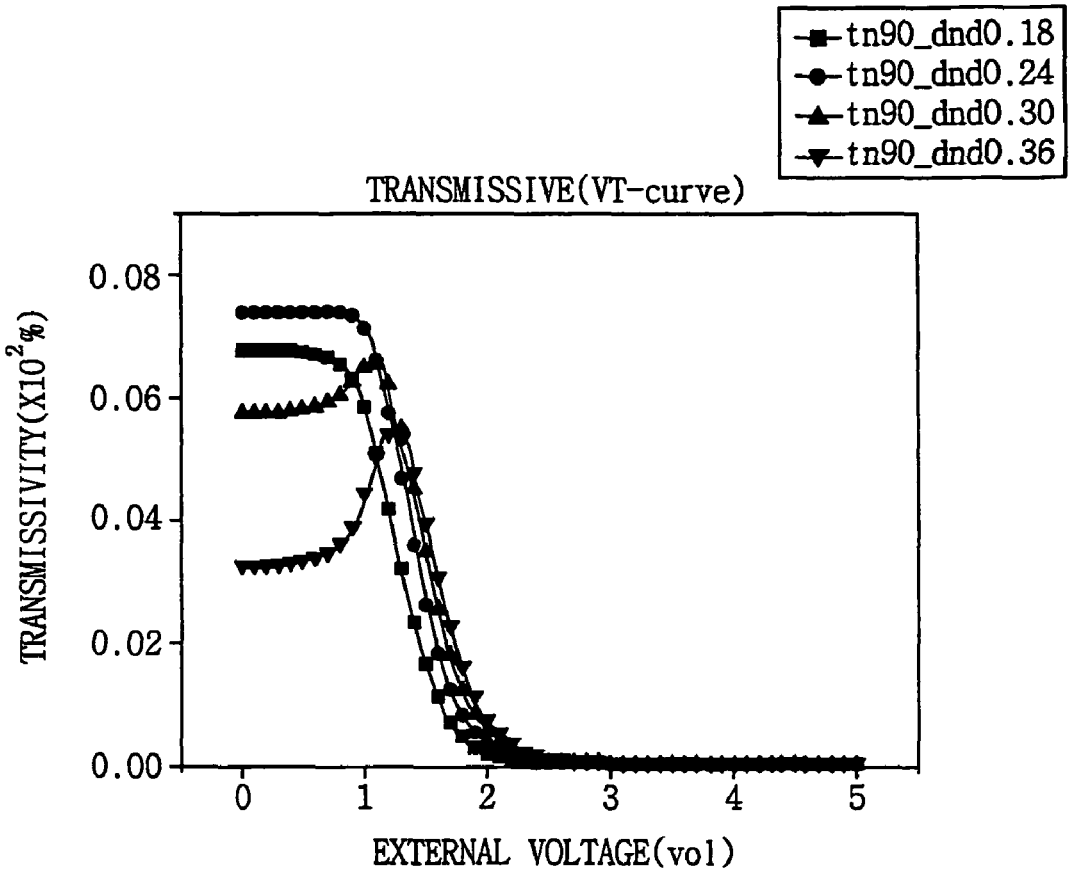
Figure 5A:
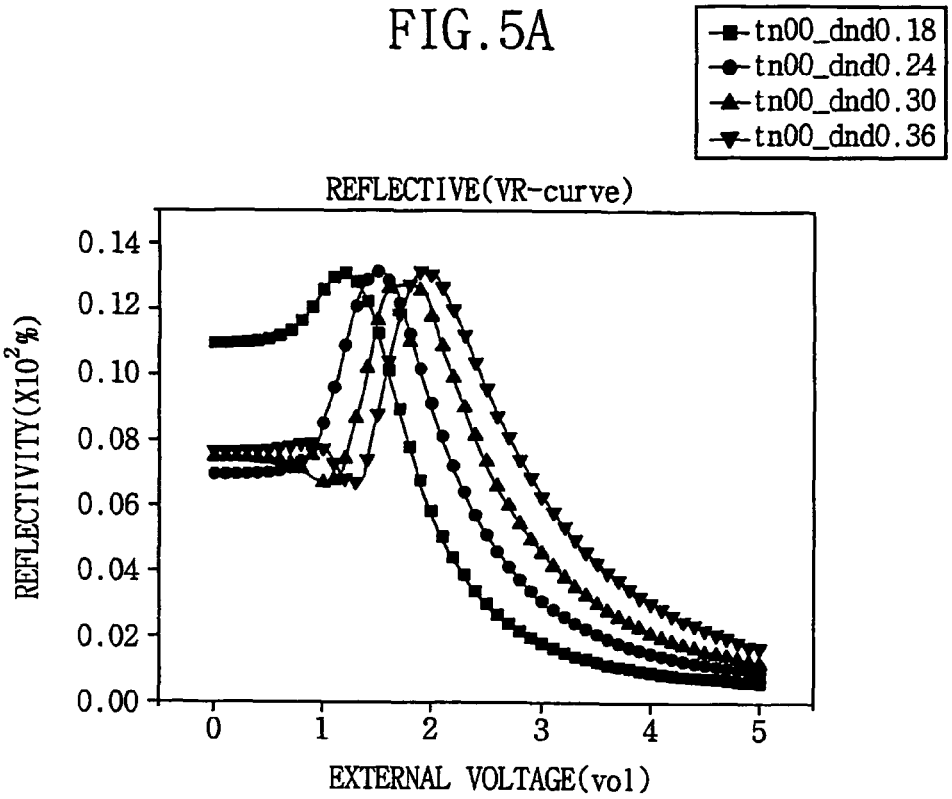
FIGS. 5A, 5B, 5C, 5D and 5E are graphs showing V-R curves depending on twist angles and Δnd of the liquid crystal molecules in TN mode according to the first exemplary embodiment of the present invention.
Figure 5B:
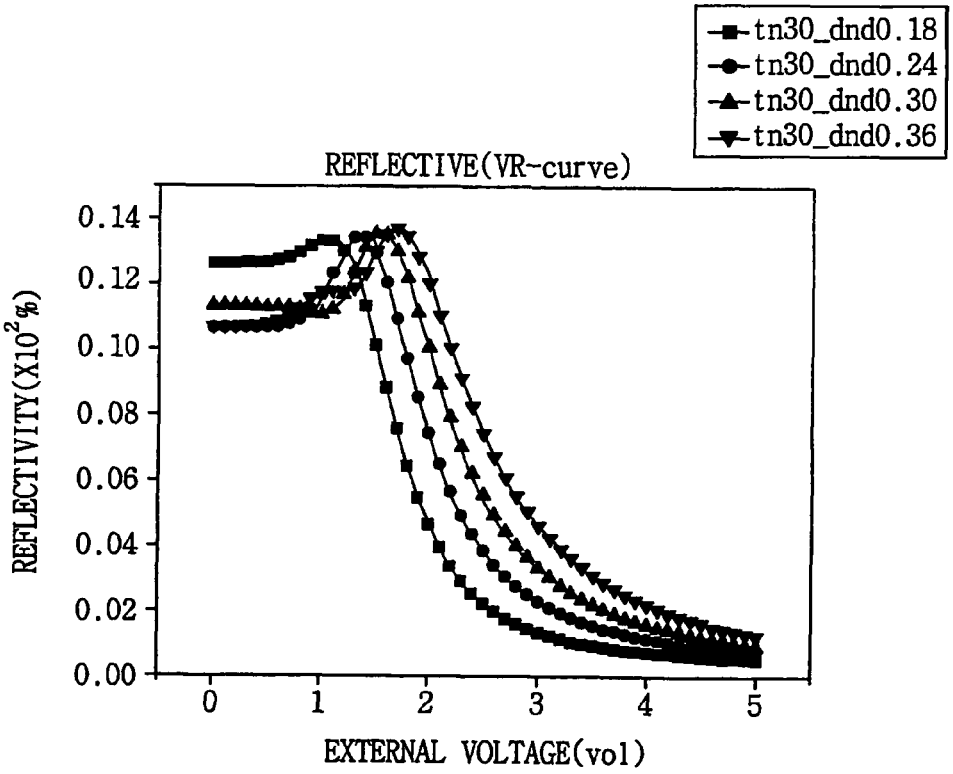
Figure 5C:
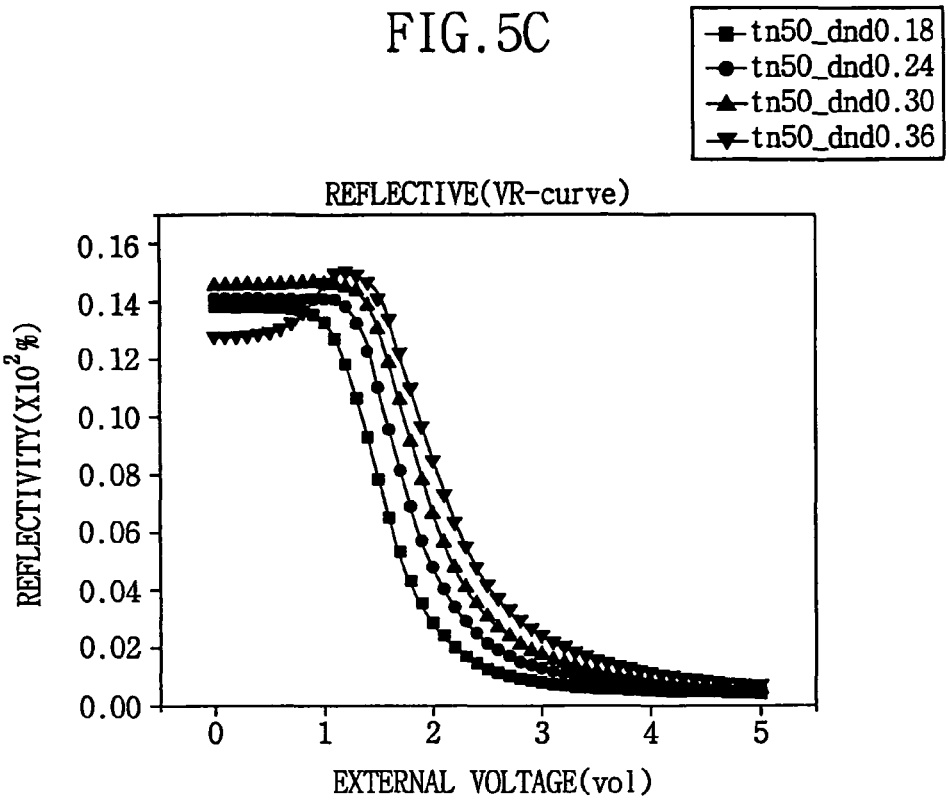
Figure 5D:
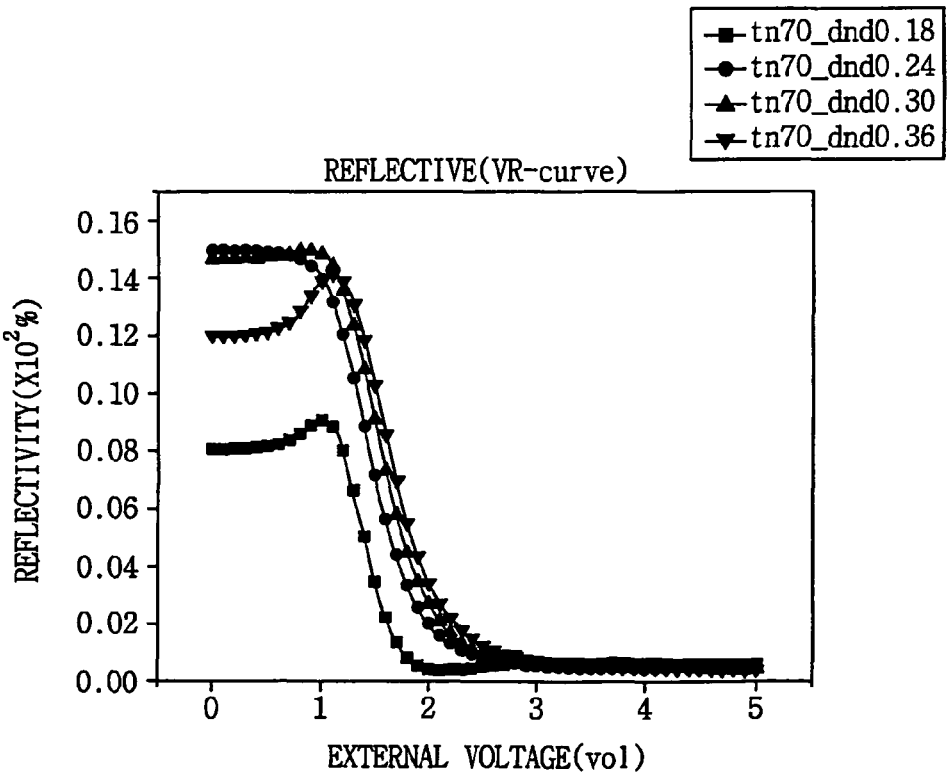
Figure 5E:
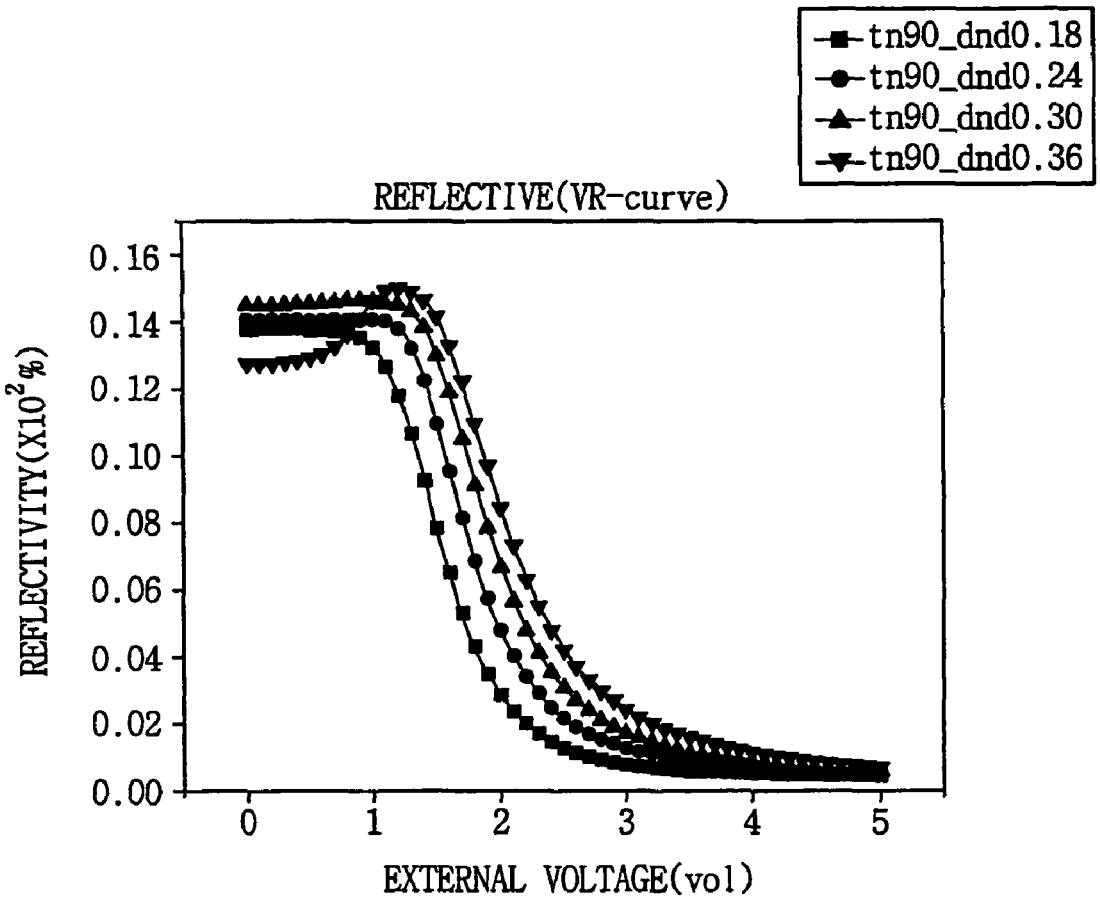

FIG. 2 is a layout showing a thin film transistor substrate of FIG. 1, and FIG. 3 is a cross-sectional view cut along a lien III-III' of FIG. 2.

A gate wiring is formed on an insulation substrate 110. The gate wiring may have a single layer comprised of silver (Ag), silver alloy, aluminum (Al), aluminum alloy, or a multi-layer comprised of silver (Ag), silver alloy, aluminum (Al), aluminum alloy. The gate wiring includes a gate line 121, a gate pad 125 and a gate electrode 123 of a thin film transistor. The gate line 121 is extended in a first direction. The gate pad 125 is connected to an end of the gate line 121, receives an external gate driving signal and applies the gate driving signal to the gate line 121. The gate electrode of the thin film transistor is connected to the gate line 121. When the gate wiring has multi-layer, it is preferable that the gate wiring comprises the material easily contactable with other material.

A gate insulation layer 140 comprised of silicon nitride (SiNx) is formed on the insulation substrate 110 on which the gate wiring is formed.

A semiconductor layer 151 comprised of semiconductor material such as amorphous silicon is formed on the gate insulation layer 140 to be disposed over the gate electrode 123. An ohmic contact layer 163 and 165 is formed over the semiconductor layer 151. The ohmic contact layer 163 and 165 comprises silicides or $n^+$ doped hydrogenated amorphous silicon (a-Si:H).

A data wiring is formed on the ohmic contact layer 163 and 165 and the gate insulation layer 140. The data wiring comprises a conductive material such as aluminum or silver. The data wiring includes a data line 171, a source electrode 173, a data pad 179 and a drain electrode 175. The data line 171 is extended in a second direction substantially perpendicular to the first direction. Pixel region is surrounded by the gate line 121 and the data line 171. The source electrode 173 is connected to the data line 171 and is extended onto an upper surface of the ohmic contact layer 163. The data pad 179 is connected to an end of the data line 171 and receives image signal. The drain electrode 175 is formed on the ohmic contact layer 163 to be opposite to the source electrode 173.

A passivation layer 801 is formed over the data wiring and the semiconductor layer 151. The passivation layer 801 comprises an inorganic material such as silicon nitride (SiNx) or an organic material such as acrylic material. The passivation layer 801 comprises a-Si:C:O film and a-Si:O:F film (a low dielectric CVD film).

The a-Si:C:O film and a-Si:O:F film is deposited by a plasma enhanced chemical vapor deposition (PECVD) and have a very low dielectric constant less than about 4. Accordingly, the passivation layer reduces parasitic capacitance. The a-Si:C:O film and a-Si:O:F film is easily contactable with other layer and has an excellent step coverage. The a-Si:C:O film and a-Si:O:F film has a superior thermal endurance to the organic insulation layer since the a-Si:C:O film and a-Si:O:F film comprises inorganic material. The a-Si:C:O film and a-Si:O:F film is deposited or etched away from about 4 to about 10 times faster than the silicon nitride film, and the processing time is reduced.

The passivation layer 801 has contact holes 181 and 183 exposing the drain electrode 175 and the data pad 179, respectively, and contact hole 182 exposing the gate pad 125 and gate insulation layer 140.

A transparent electrode 90 is formed on the passivation layer 801 to be disposed over the pixel. The transparent electrode 90 has a contact hole 181 through which the transparent electrode 90 is electrically connected to the drain electrode 175. A subsidiary gate pad 95 and a subsidiary data pad 97 are formed on the passivation layer 801. The subsidiary gate pad 95 and subsidiary data pad 97 is electrically connected to the gate pad 125 and data pad 179 through the contact holes 182 and 183, respectively.

The transparent electrode 90, subsidiary gate pad 95 and subsidiary data pad 97 comprises a transparent material such as indium tin oxide (ITO) or indium zinc oxide (IZO) etc.

An insulating interlayer 802 is formed on the transparent electrode 90. The insulating interlayer 802 has a contact hole 184 exposing a portion of the transparent electrode 90. The insulating interlayer 802 may have an embossing pattern so as to enhance the reflectivity of the reflection layer 80.

The insulating interlayer 802 comprises an inorganic material such as silicon nitride (SiNx), an organic material such as acrylic material, a-Si:C:O film, or a-Si:O:F film (a low dielectric CVD film).

The reflection layer 80 is formed on the insulating interlayer 802. The reflection layer 80 has a contact hole 184 through which the reflection layer 80 is electrically connected to the transparent electrode 90. The reflection layer 80 has an opening 82 that serves as a transmissive window in the transmissive mode. The reflection layer 80 comprises a conductive material having a high reflectivity such as aluminum (Al), aluminum alloy, silver (Ag), silver alloy, molybdenum, or molybdenum alloy etc. A pixel electrode includes the reflection layer 80 and the transparent electrode 90. The opening 82 may have various shapes, and a pixel may have a plurality of openings 82. Even though the insulating interlayer 802 has the embossing pattern, it is preferably that the opening 82 may not have embossing pattern.

A capacitance exists between the pixel electrode (80 and 90) and the gate line 121.

Color filters, black matrix and common electrode are formed on the color filter substrate 200.

The twist angles of the liquid crystal molecules are in a range from about 0° to 50°, and the Δnd of the liquid crystal layer is in a range from about 0.15 to about 0.35. Therefore, superior transmissivity, reflectivity and contrast ratio may be acquired in both transmissive mode and reflective mode.

FIGS. 4A, 4B, 4C, 4D and 4E are graphs showing V-T curves depending on twist angles and Δnd of liquid crystal molecules in TN mode according to the first exemplary embodiment of the present invention. FIGS. 5A, 5B, 5C, 5D and 5E are graphs showing V-R curves depending on twist angles and Δnd of the liquid crystal molecules in TN mode according to the first exemplary embodiment of the present invention. FIGS. 4A, 4B, 4C, 4D and 4E show the case in which the twist angles are 0°, 30°, 50°, 70° and 90°, and FIGS. 5A, 5B, 5C, 5D and 5E show the case in which the twist angles are 0°, 30°, 50°, 70° and 90°, Referring to table 1, FIGS. 4A, 4B, 4C, 4D, 4E, 5A, 5B, 5C, 5D and 5E, the less the twist angle is, the less is the contrast ratio (CR) in both transmissive and reflective modes, but far larger is the transmissivity in the transmissive mode.

Accordingly, it is preferable that the twist angle is 0° in aspect of the transmissivity. When the twist angle is in a range from about 0° to about 50°, the transmissivity is maintained more than about 13.9%, and the reflectivity is maintained more than about 13.1%.

The smaller the voltage applied to the liquid crystal layer is, the larger is the transmissivity and the reflectivity in both transmissive and reflective modes. When the voltage applied to the liquid crystal layer is less than a predetermined value, the transmissivity and the reflectivity decrease according as the voltage applied to the liquid crystal layer decreases. This phenomenon is referred to as "inversion phenomenon". However, the voltage where the inversion phenomenon occurs in the transmissive mode is different from the voltage where the inversion phenomenon occurs in the reflective mode. Accordingly, since the range of the voltage used for representing the gray scale varies depending on the transmissive and reflective modes, the range of the voltage is regulated according to the transmissive and reflective modes. The gray scale voltage applied to the data line is regulated in response to the turn-on or turn-off of the backlight according to the transmissive and reflective modes.

TABLE 1

| TN mode | | | | | | | | | |
|---|---|---|---|---|---|---|---|---|---|
| mode | | Transmissive | | | | | reflective | | |
| twist angle | Δnd | T (%) | CR | voltage (volt) | CR | voltage (volt) | R (%) | CR | Voltage (volt) |
| 0 | 0.18 | 18.5 | 50:1 | 0.5-4.5 | | | 13.1 | 18:1 | 1.2-4.5 |
| (ECB) | 0.24 | 22.5 | 35:1 | 0.7-4.5 | | | 13.2 | 12:1 | 1.5-4.5 |
| | 0.30 | 22.7 | 23:1 | 1.1-4.5 | | | 13.1 | 8.4:1 | 1.7-4.5 |
| | 0.36 | 22.8 | 16:1 | 1.3-4.5 | | | 13.2 | 5.9:1 | 1.9-4.5 |
| 30 | 0.18 | 17.0 | 58:1 | 0.5-4.1 | | | 13.3 | 22:1 | 1.0-4.5 |
| | 0.24 | 20.2 | 41:1 | 0.7-4.2 | | | 13.4 | 15:1 | 1.3-4.5 |
| | 0.30 | 20.3 | 26:1 | 1.1-4.5 | | | 13.5 | 12:1 | 1.5-4.5 |
| | 0.36 | 20.1 | 18:1 | 1.3-4.1 | | | 13.7 | 8.4:1 | 1.7-4.5 |
| 50 | 0.18 | 13.9 | 82:1 | 0.5-4.2 | | | 13.8 | 28:1 | 0.7-4.5 |
| | 0.24 | 16.5 | 57:1 | 0.7-4.5 | | | 14.2 | 23:1 | 0.9-4.5 |
| | 0.30 | 16.3 | 37:1 | 1.1-4.5 | | | 14.8 | 21:1 | 1.1-4.5 |
| | 0.36 | 15.7 | 25:1 | 1.3-4.5 | | | 15.2 | 17:1 | 1.2-4.5 |
| 70 | 0.18 | 10.4 | 162:1 | 0.5-4.5 | 72:1 | 0.5-3.5 | 9.1 | 15:1 | 1.0-3.5 |
| (TN) | 0.24 | 12.0 | 120:1 | 0.7-4.5 | 64:1 | 0.7-3.5 | 14.8 | 30:1 | 0.7-3.5 |
| | 0.30 | 11.3 | 76:1 | 1.1-4.5 | 39:1 | 1.1-3.5 | 14.9 | 30:1 | 0.9-3.5 |
| | 0.36 | 11.4 | 74:1 | 1.1-4.5 | 38:1 | 1.1-3.5 | 14.1 | 26:1 | 1.1-3.5 |
| 90 | 0.18 | 6.8 | 354:1 | 0.5-4.5 | 307:1 | 0.5-3.0 | 10.2 | 18:1 | 0.5-3.0 |
| (TN) | 0.24 | 7.4 | 385:1 | 0.7-4.5 | 286:1 | 0.7-3.0 | 11.7 | 20:1 | 0.6-3.0 |
| | 0.30 | 6.6 | 334:1 | 1.1-4.5 | 200:1 | 1.1-3.0 | 10.9 | 18:1 | 0.9-3.0 |
| | 0.36 | 5.4 | 266:1 | 1.2-4.5 | 126:1 | 1.2-3.0 | 9.1 | 15:1 | 1.0-3.0 |

(T (%): transmissivity, R (%): reflectivity, CR: contrast ratio)

Figure 6:
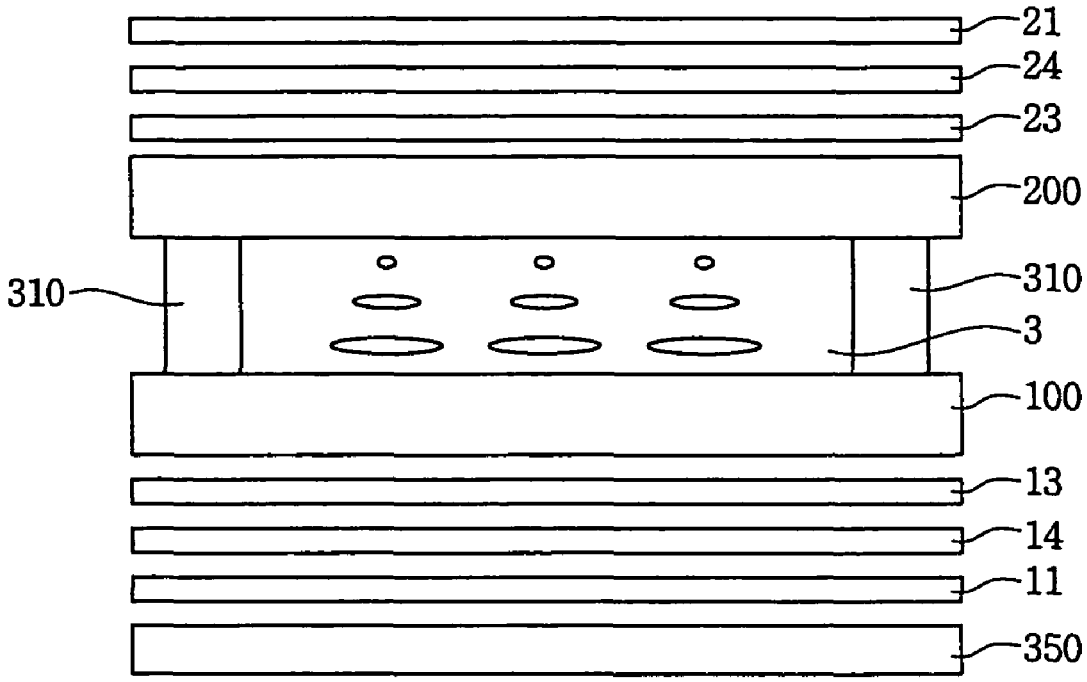
FIG. 6 is a cross-sectional view showing a liquid crystal display panel according to a second exemplary embodiment of the present invention.
Figure 7A:
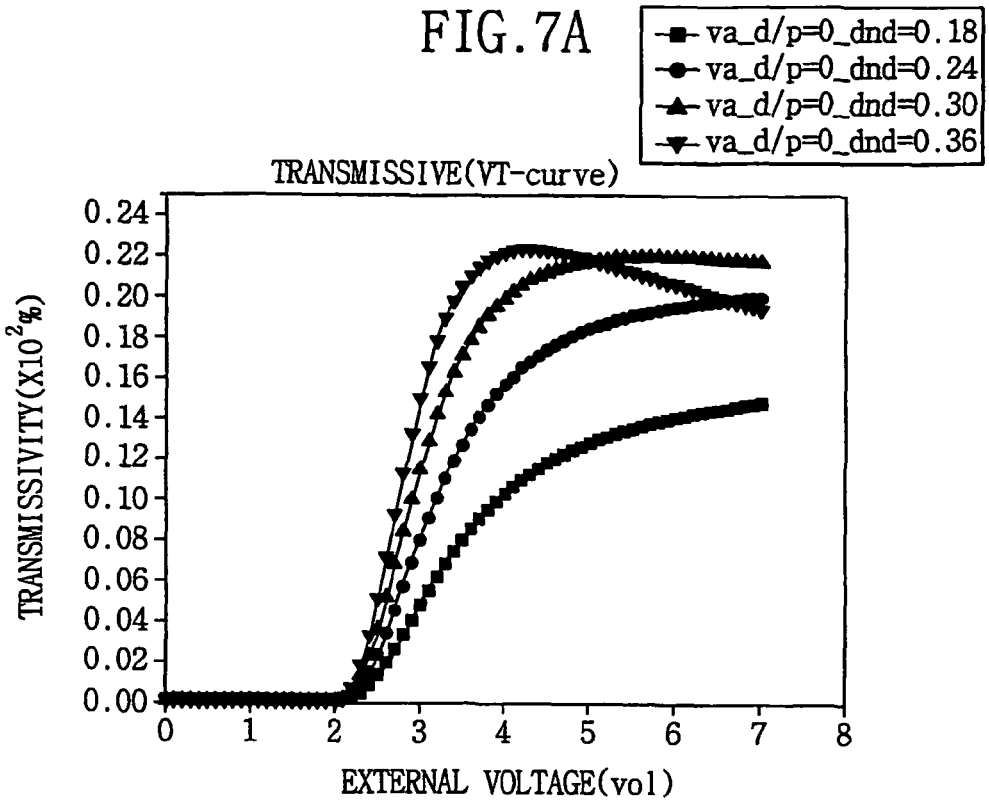
FIGS. 7A, 7B, 7C and 7D are graphs showing V-T curves depending on amount of dopant and Δnd of the liquid crystal molecules in VA mode according to the second exemplary embodiment of the present invention.
Figure 7B:
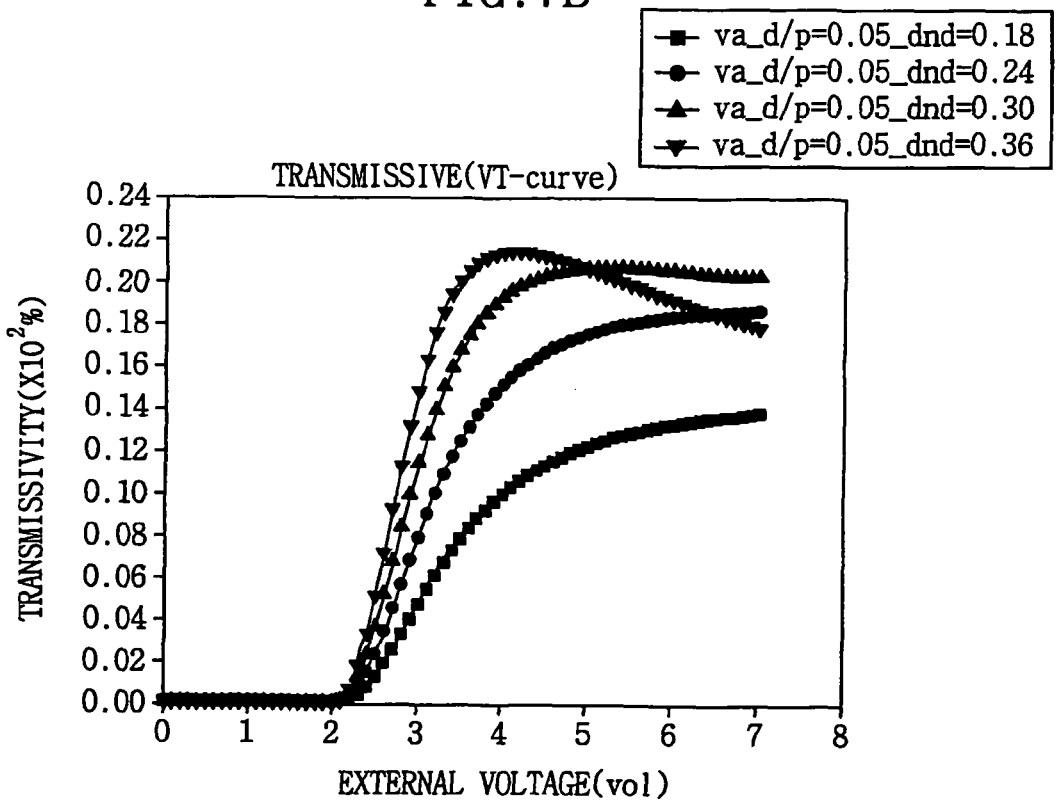
Figure 7C:
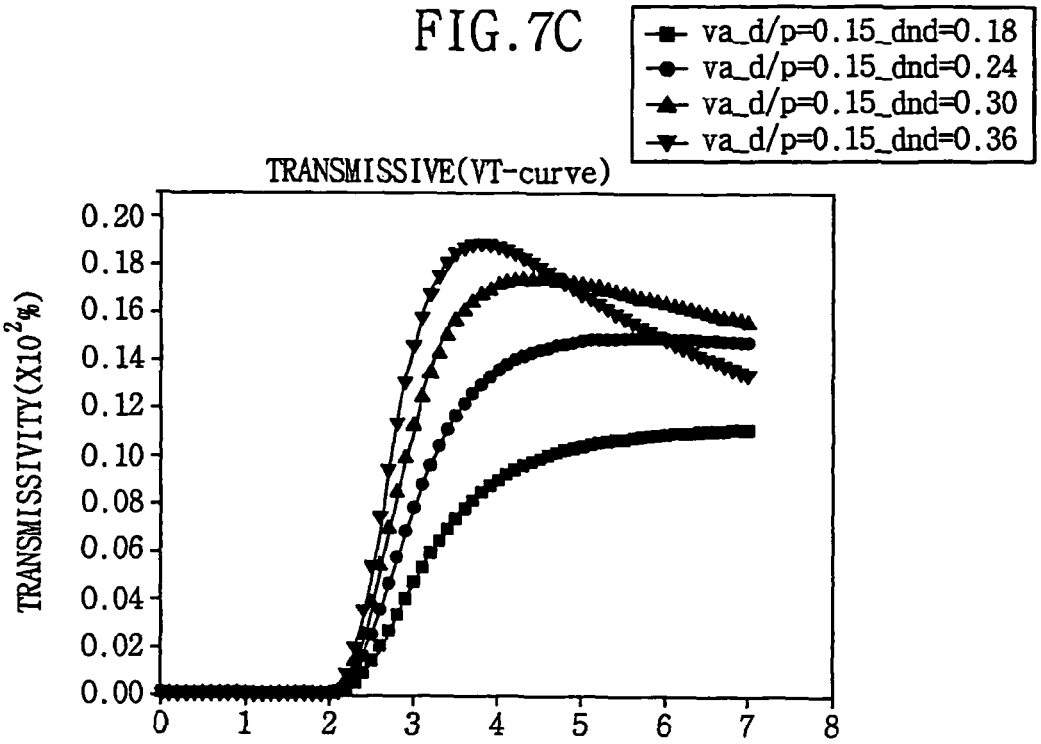
Figure 7D:
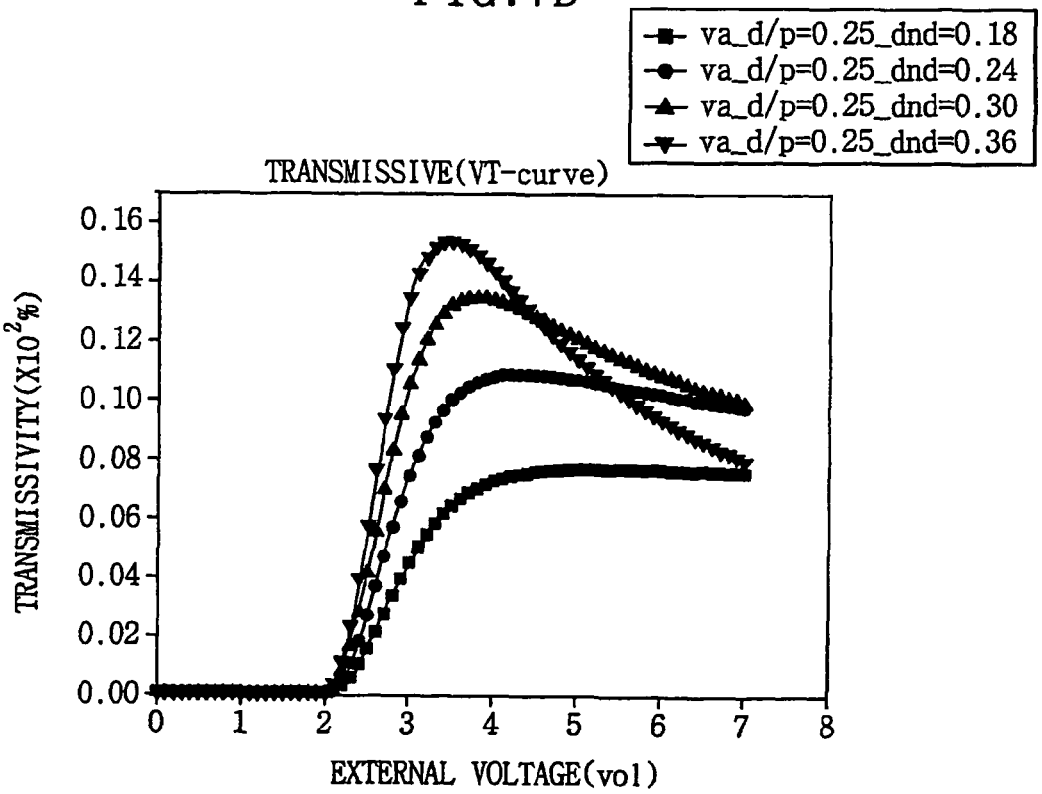
Figure 8A:
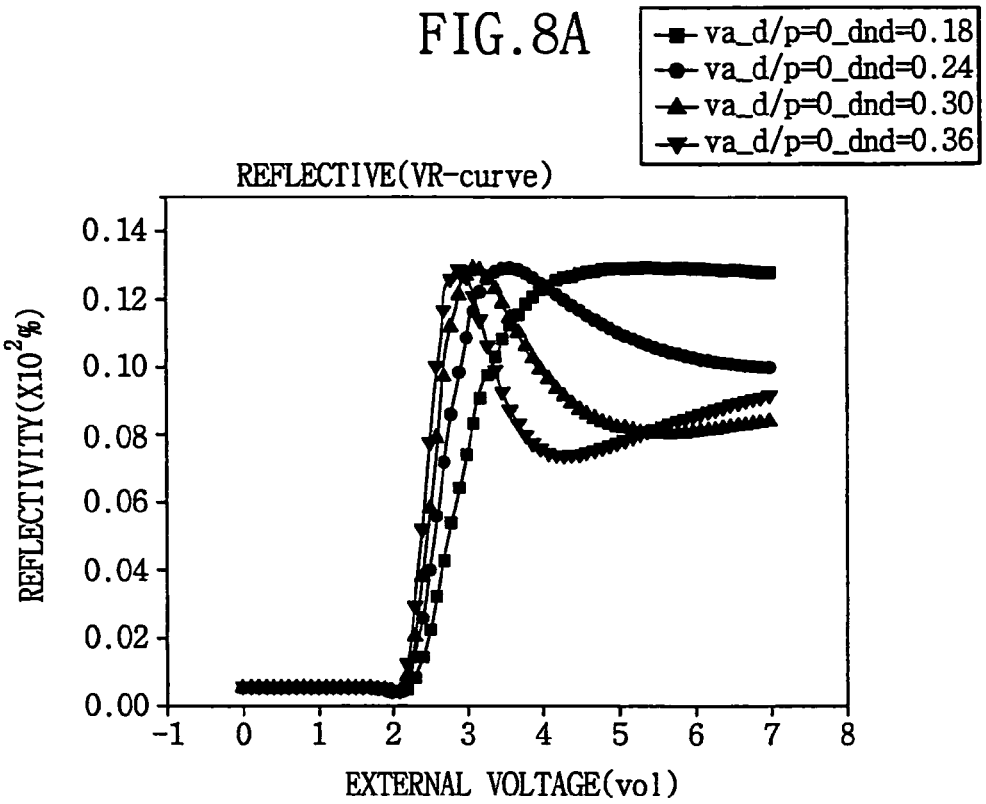
FIGS. 8A, 8B, 8C and 8D are graphs showing V-R curves depending on amount of dopant and Δnd of the liquid crystal molecules in VA mode according to the second exemplary embodiment of the present invention.
Figure 8B:
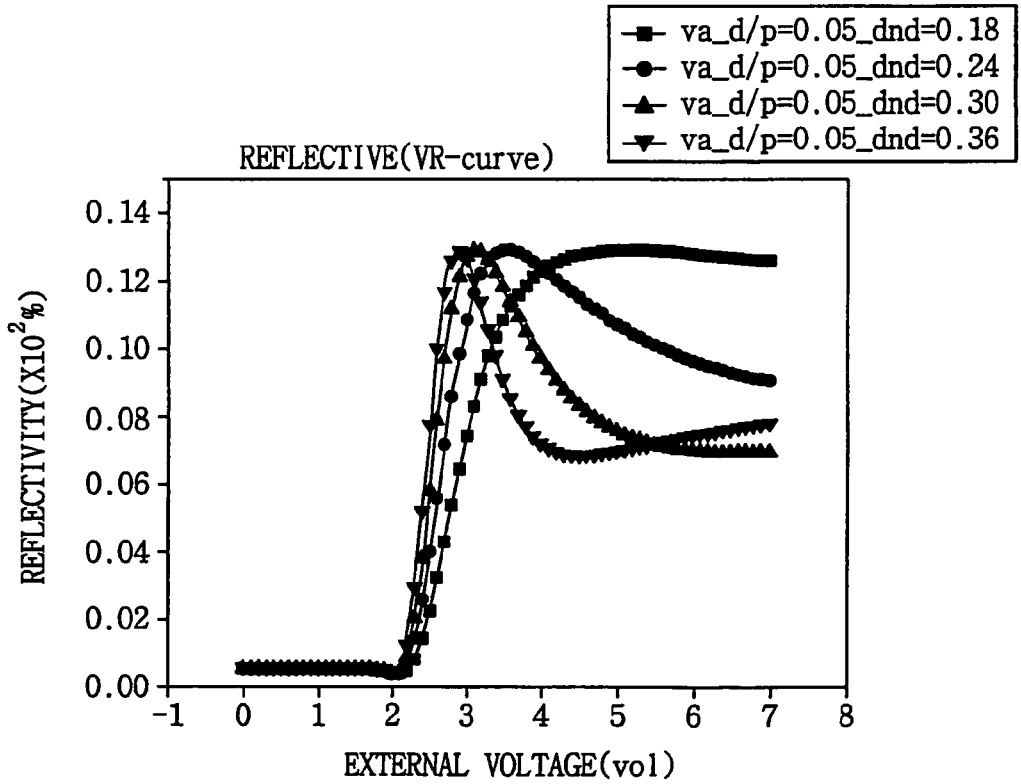
Figure 8C:
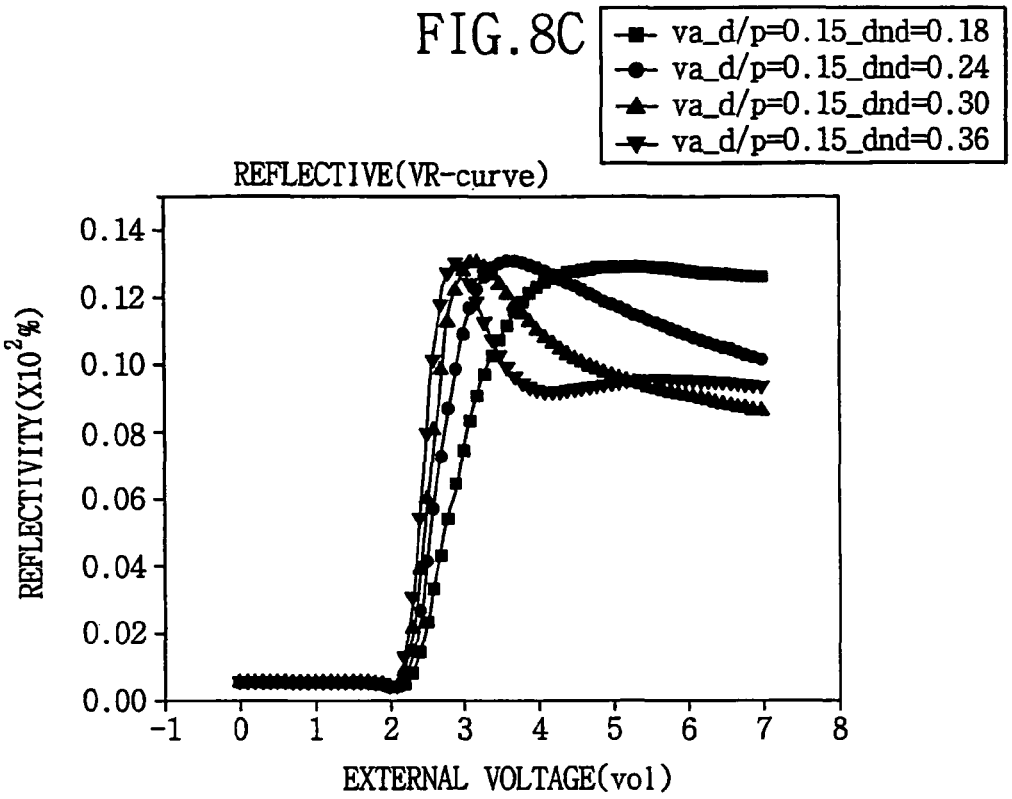
Figure 8D:
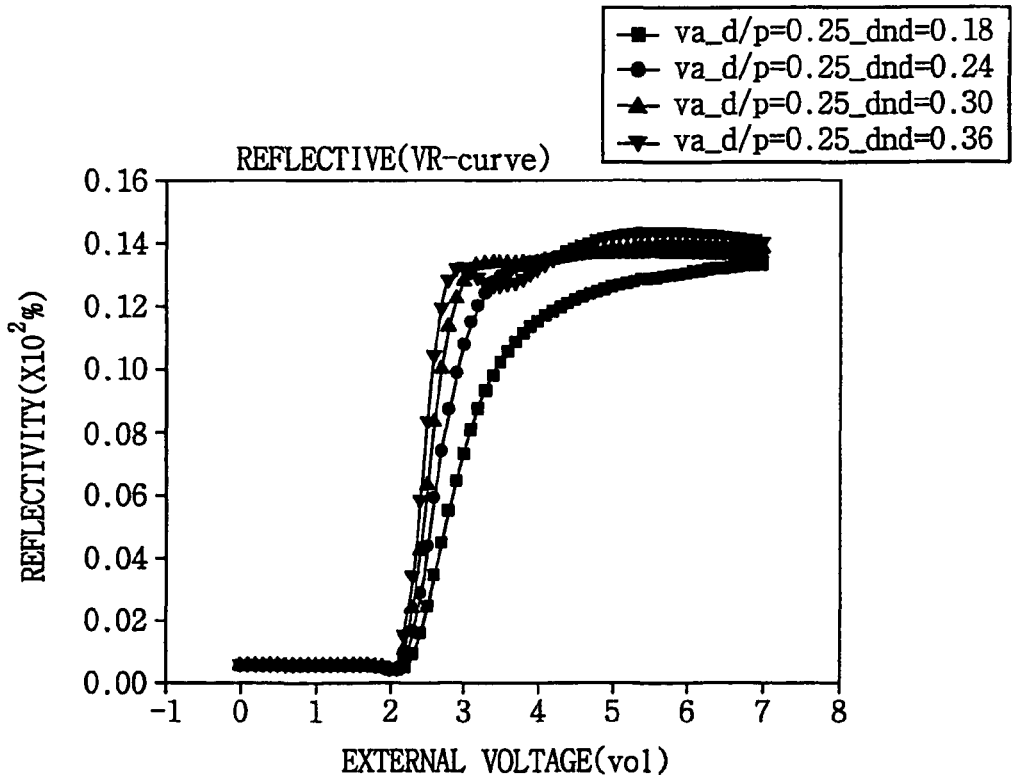

FIG. 6 is a cross-sectional view showing a liquid crystal display panel according to a second exemplary embodiment of the present invention.

Referring to FIG. 6, the liquid crystal display device according to the second exemplary embodiment of the present invention has the same structure except the orientation of the liquid crystal molecules. According to the first exemplary embodiment of the present invention, the liquid crystal molecules of the liquid crystal layer 3 are vertically aligned. (VA mode; vertically aligned mode) Namely, the major axises of the liquid crystal molecules of the liquid crystal layer 3 are twisted in substantially 90° angles with respect to the thin film transistor substrate 100 and the color filter substrate 200.

The liquid crystal layer comprises small amount of chiral dopant so that the ratio (d/p) of a cell gap (d) to a pitch (p) of the liquid crystal layer is in a range from about 0 to about 0.15. When electric field is applied to the liquid crystal layer, the twist angles of the liquid crystal molecules may be in a range from about 0° to about 50°. The Δnd of the liquid crystal layer may be in a range from about 0.15 to about 0.35.

FIGS. 7A, 7B, 7C and 7D are graphs showing V-T curves depending on amount of dopant and Δnd of the liquid crystal molecules in VA mode according to the second exemplary embodiment of the present invention. FIGS. 8A, 8B, 8C and 8D are graphs showing V-R curves depending on amount of dopant and Δnd of the liquid crystal molecules in VA mode according to the second exemplary embodiment of the present invention. FIGS. 7A, 7B, 7C, 7D, 8A, 8B, 8C and 8D show the results of table 2. FIGS. 7A, 7B, 7C and 7D represent the case in which the amount of the dopant is 0, 0.05, 0.15, 0.25, and FIGS. 8A, 8B, 8C and 8D show the case in which the amount of the dopant is 0, 0.05, 0.15, 0.25.

Referring to table 2, FIGS. 7A, 7B, 7C, 7D, 8A, 8B, 8C and 8D, the VA mode has superior contrast ratio of the transmissive mode to that of the twisted nematic (TN) mode. Accordingly, in the VA mode, the contrast ratio does not decrease even when the twist angle approaches to 0°.

ever, the voltage where the inversion phenomenon occurs in the transmissive mode is different from the voltage where the inversion phenomenon occurs in the reflective mode. Accordingly, since the range of the voltage representing the gray scale varies depending on the transmissive and reflective modes, the range of the voltage is regulated according to the transmissive and reflective modes. The gray scale voltage applied to the data line is regulated in response to the turn-on or turn-off of the backlight according to the transmissive and reflective modes. (Refer to FIG. 12)

TABLE 2

| VA mode | | | | | | | |
|---|---|---|---|---|---|---|---|
| | | Transmissive type | | | | Reflective type | |
| mode | | Transmis- | | Volt- | Reflec- | | Volt- |
| dopant | Δnd | sitivity | CR | age | tivity (%) | CR | age |
| 0 | 0.18 | 11.8 | 622:1 | 1.8-4.5 | 12.9 | 25:1 | 1.8-4.5 |
| (Reverse | 0.24 | 17.4 | 911:1 | 1.8-4.5 | 13.0 | 26:1 | 1.8-3.6 |
| ECB) | 0.30 | 21.2 | 1100:1 | 1.8-4.5 | 13.0 | 26:1 | 1.8-3.1 |
| | 0.36 | 22.4 | 1160:1 | 1.8-4.3 | 13.0 | 23:1 | 1.8-2.9 |
| 0.05 | 0.18 | 11.4 | 599:1 | 1.8-4.5 | 12.9 | 25:1 | 1.8-4.5 |
| | 0.24 | 16.8 | 875:1 | 1.8-4.5 | 13.0 | 26:1 | 1.8-3.6 |
| | 0.30 | 20.4 | 1060:1 | 1.8-4.5 | 13.0 | 26:1 | 1.8-3.1 |
| | 0.36 | 21.5 | 1110:1 | 1.8-4.1 | 13.0 | 23:1 | 1.8-2.9 |
| 0.15 | 0.18 | 9.9 | 516:1 | 1.8-4.5 | 12.8 | 25:1 | 1.8-4.5 |
| | 0.24 | 14.4 | 746:1 | 1.8-4.5 | 13.1 | 26:1 | 1.8-3.7 |
| | 0.30 | 17.3 | 888:1 | 1.8-4.4 | 13.1 | 26:1 | 1.8-3.2 |
| | 0.36 | 18.8 | 955:1 | 1.8-3.8 | 12.2 | 24:1 | 1.8-2.9 |
| 0.25 | 0.18 | 7.6 | 365:1 | 1.8-4.5 | 12.2 | 24:1 | 1.8-4.5 |
| (Reverse | 0.24 | 11.0 | 561:1 | 1.8-4.3 | 13.5 | 27:1 | 1.8-4.1 |
| | 0.30 | 13.6 | 685:1 | 1.8-3.8 | 13.3 | 26:1 | 1.8-3.5 |
| | 0.36 | 15.5 | 765:1 | 1.8-3.5 | 13.2 | 23:1 | 1.8-3.0 |

Table 3 represents the two examples of the present invention and the comparative examples.

TABLE 3

| | | | | | transmissive mode | | reflective mode | |
|---|---|---|---|---|---|---|---|---|
| | LC mode | Δnd | twist angle | d/p | voltage (volt) | T (%) (C/R) | voltage (volt) | R (%) (C/R) |
| comparative example 1 | TN mode | 0.24 | 90° | 0.07 | 0.7/3.0 | 7.4 (286) | 0.6/3.0 | 11.7 (20) |
| comparative example 2 | TN mode | 0.24 | 70° | 0.07 | 0.7/3.5 | 12.0 (64) | 0.7/3.5 | 14.8 (30) |
| example 1 | VA (reverse ECB) mode | 0.30 | — | 0 | 1.8/4.5 | 21.2 (1100) | 1.8/3.1 | 13.0 (26) |
| example 2 | ECB mode | 0.24 | 0° | 0.07 | 0.7/4.5 | 22.5 (35) | 1.5/4.5 | 13.2 (12) |

(T (%): transmissivity, R (%): reflectivity)

As shown in table 2, FIGS. 7A, 7B, 7C, 7D, 8A, 8B, 8C and 8D, according as the amount of the chiral dopant decreases, the reflectivity very slowly decreases, but the transmissivity of the transmissive mode abruptly increases. Therefore, it is preferable that the amount of the chiral dopant is 0 in aspect of transmissivity.

The larger the voltage applied to the liquid crystal layer is, the larger is the transmissivity and the reflectivity in both transmissive and reflective modes. When the voltage applied to the liquid crystal layer is more than a predetermined value, the transmissivity and the reflectivity decrease according as the voltage applied to the liquid crystal layer increases. This phenomenon is referred to as "inversion phenomenon". How- Referring to table 3, when the chiral dopant was not added, the VA mode has the most excellent characteristics of all LC modes.

Figure 9:
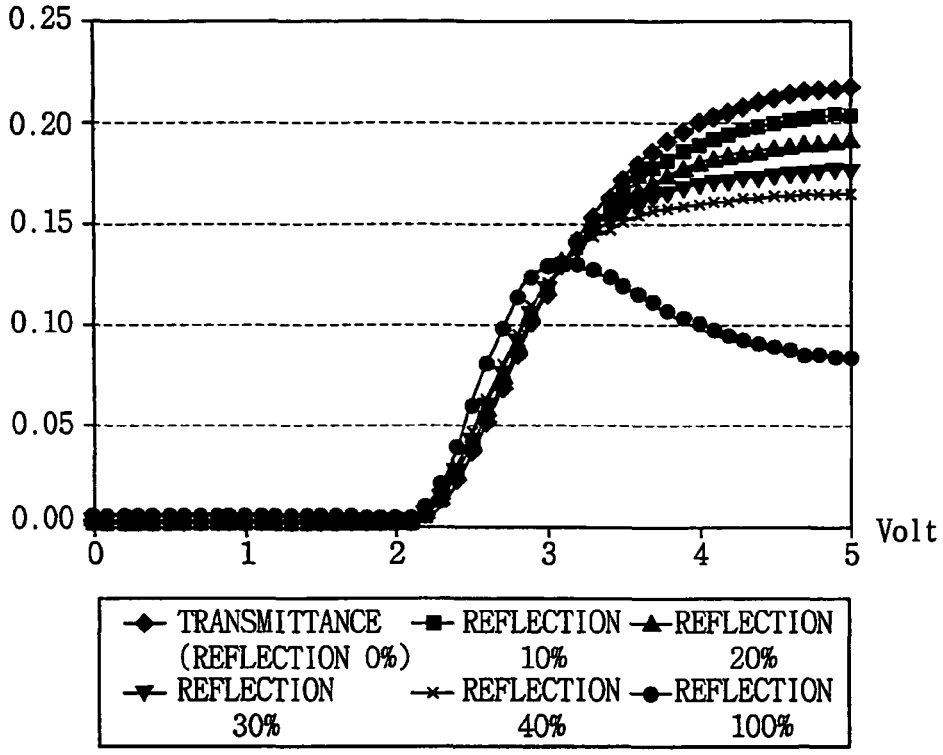
FIG. 9 is a graph showing a V-T curve and a V-R curve depending on applied voltage in VA mode.
Figure 10:
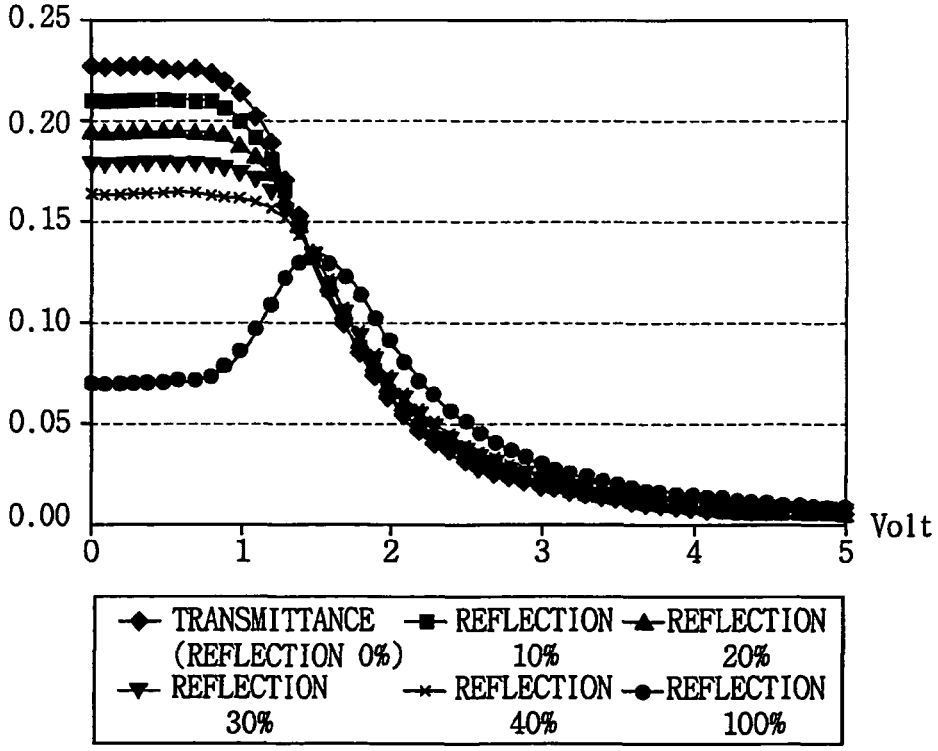
FIG. 10 is a graph showing a V-T curve and a V-R curve depending on applied voltage in ECB mode.

FIG. 9 is a graph showing a V-T curve and a V-R curve depending on applied voltage in VA mode, and FIG. 10 is a graph showing a V-T curve and a V-R curve depending on applied voltage in ECB mode.

As shown in FIGS. 9 and 10, since the luminance curve of the transmissive mode is determined according to the ratio of the luminance of the transmissive mode to the luminance of the reflective mode, a standard external light is need to be determined when the gray scale is measured so as to determine the gray scale voltage of the transmissive mode.

Figure 11:
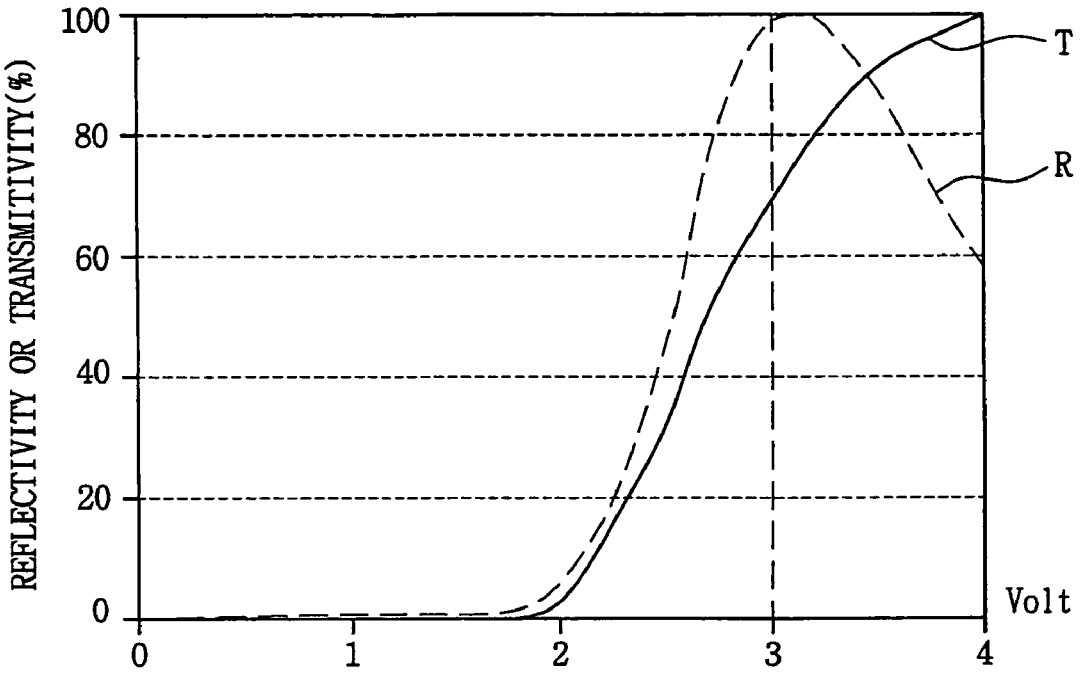
FIG. 11 is a graph showing a V-T curve and a V-R curve depending on applied voltage in transmissive mode and reflective mode.

FIG. 11 is a graph showing a V-T curve and a V-R curve depending on applied voltage in transmissive mode and reflective mode. An X-axis represents voltage, and a Y-axis represents reflectivity (%) or transmissivity (%).

Hereinafter, for example, 64 levels of gray scale (6 bits of gray scale data) are illustrated. However, 128 levels of gray scale (8 bits of gray scale data) or other levels of gray scales may be used in the present invention.

Referring to FIG. 11, the effective range of transmissive mode gray scale voltage applied to the liquid crystal layer is from about 1.5 volts to about 4 volts, or the effective range of transmissive mode gray scale voltage applied to the liquid crystal layer may be from about 0 volt to about 4 volts. The effective range of reflective mode gray scale voltage applied to the liquid crystal layer is from about 1.5 volts to about 3 volts, or the effective range of reflective mode gray scale voltage applied to the liquid crystal layer may be from about 1.5 volts to about 3 volts.

Namely, the effective range of the gray scale voltage applied to the liquid crystal layer varies according to the transmissive mode or the reflective mode. The effective range of the gray scale voltage applied to the liquid crystal layer may be changed according to the liquid crystal mode (VA mode, TN mode, etc.), twist angle, Δnd and d/p.

Hereinafter, there is disclosed a gray scale voltage generator and a method of generating the gray scale voltage, the gray scale voltage generator and a method of generating the gray scale voltage provides satisfactory display quality in both transmissive and reflective modes when the effective range of the gray scale voltage in the transmissive mode is different from that in the reflective mode.

Figure 12:
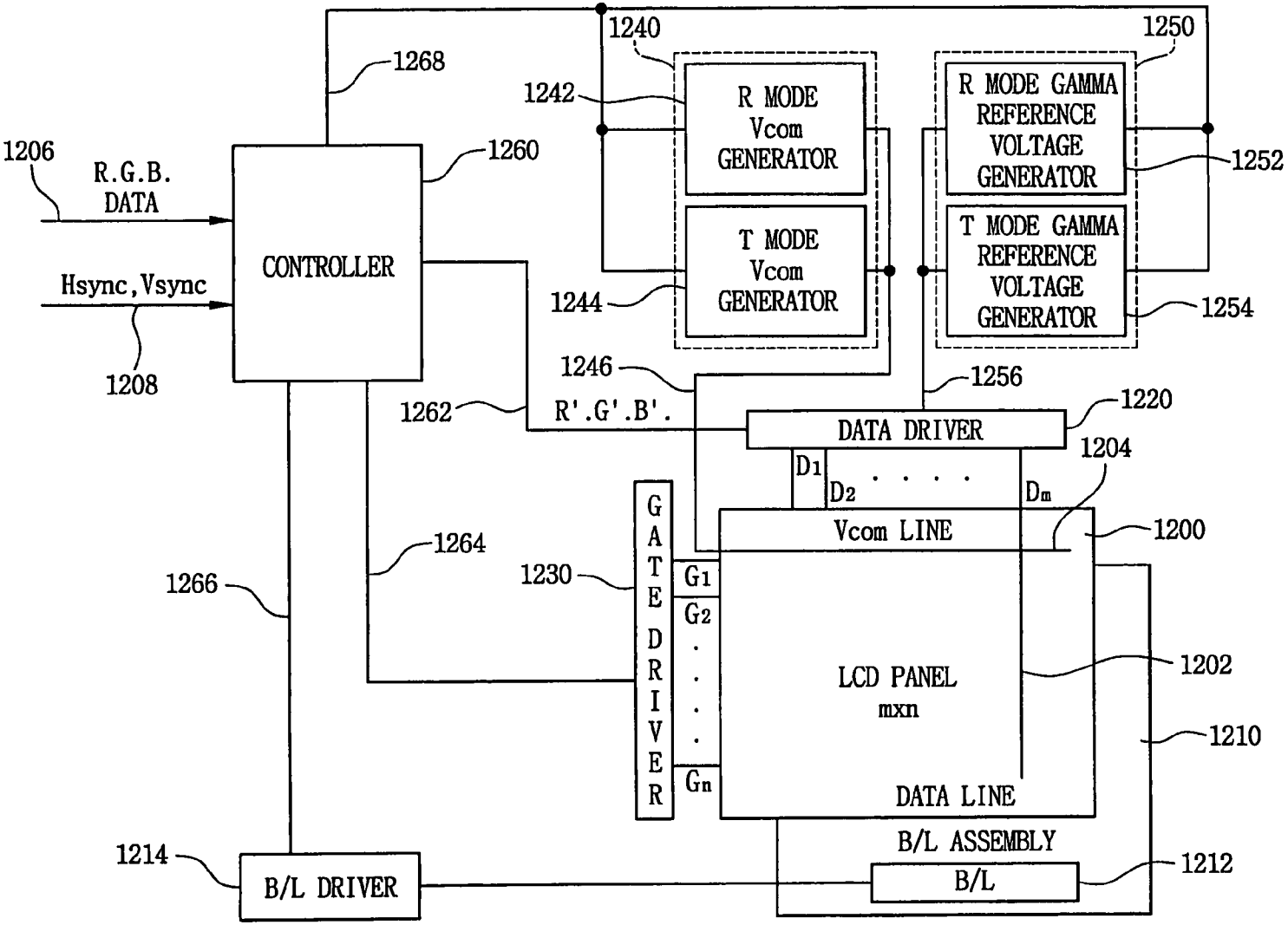
FIG. 12 is a block diagram showing a liquid crystal display device according to a third exemplary embodiment of the present invention.

FIG. 12 is a block diagram showing a liquid crystal display device according to a third exemplary embodiment of the present invention.

Referring to FIG. 12, the liquid crystal display device includes a liquid crystal display panel 1200, a backlight assembly 1210, a data driver 1220, a gate driver 1230, a backlight driver 1214, a controller 1260, a common voltage generator 1240 and a gamma reference voltage generator 1250.

The liquid crystal display panel 1200 includes an upper substrate (not shown), a lower substrate (not shown) and a liquid crystal layer (not shown) interposed between the upper and lower substrates.

A pixel includes a thin film transistor and a pixel electrode, and m*n pixels are arranged in a matrix shape on the lower substrate. R.G.B color filters and common electrode are formed on the upper substrate.

A common voltage generated from the common voltage generator 1240 is applied to the common electrode through the common line 1204. A gamma reference voltage 1256 generated from the gamma reference voltage generator 1250 is applied to the data driver 1220.

The data driver 1220 generates a gray scale voltage 1256 that corresponds to one of the gamma reference voltages selected according to digital value of R'.G'.B' image data 1267 outputted from the controller 1260. The data driver 1220 applies the gray scale voltage to each of the pixel electrodes through the data line (D1, D2, . . . , Dm; 1202). In other words, the data driver 1220 selects one of n levels'—for example, 64 levels or 256 levels—gamma reference voltages according to the digital value of R'.G'.B'. image data 1267, and applies the selected gamma reference voltages to each of R.G.B. pixels through the data line (D1, D2, . . . , Dm; 1202), so that n*n*n colors are displayed The gate driver 1230 receives a control signal 1264 for controlling the gate driver 1230 and applies gate driving signals for driving the thin film transistors of the liquid crystal display panel 1200 to the gate lines (G1, G2, . . . , GDn).

The backlight driver 1214 supplies power voltage to the backlight, and turns on or turns off the back light. For example, the backlight driver 1214 turns on in the transmissive mode or turns off the back light in the reflective mode.

The controller 1260 receives image data (or R.G.B. image data 1206), vertical synchronization signal (Vsync) and horizontal synchronization signal (Hsync) from an external graphic controller (not shown) and generates timing signals for driving the gate driver 1230 and the data driver 1220 and digital R'.G'.B'. data.

The controller 1260 receives a status signal that represents the turn-on/off states of the backlight and determines the mode, i.e. the transmissive mode or reflective mode. The status signal is synchronized with the turn-on/off states of the backlight.

When the backlight is turned off, the controller 1260 outputs a mode selecting signal 1268 that shows a reflective mode and selects a reflective mode common voltage generator 1242 and a reflective mode gamma reference voltage generator 1252. When the backlight is turned on, the controller 1260 outputs a mode selecting signal 1268 that shows a transmissive mode and selects a transmissive mode common voltage generator 1244 and a transmissive mode gamma reference voltage generator 1254. However, the controller 1260 may have internal program that operate independently of the turn-on or turn-off status of the backlight so as to output a mode selecting signal 1268 that shows a reflective mode or a transmissive mode.

The common voltage generator 1240 receives the mode selecting signal 1268. In case of the reflective mode, the reflective mode common voltage generator 1242 outputs a reflective mode common voltage 1246 to the common line 1204. In case of the transmissive mode, the transmissive mode common voltage generator 1244 outputs a transmissive mode common voltage 1246 to the common line 1204.

The common voltage generator 1240 may employ a high voltage driving method and a low voltage driving method. In the low voltage driving method, the common voltage repeats (+) and (−) voltage level between a maximum value of the gray scale voltage and a minimum value of the gray scale voltage. In the high voltage driving method, the common voltage has a fixed voltage level. Since the characteristics of the liquid crystal layer may be deteriorated when a D.C gray scale voltage is applied to the liquid crystal, a gray scale voltage that repeats a positive gray scale voltage or a negative gray scale voltage with respect to the common voltage may be applied to each of the pixels.

The gamma reference voltage generator 1250 receives the mode selecting signal 1268. A reflective mode gamma reference voltage generator 1252 outputs a reflective mode gamma reference voltage 1256 to the data driver 1220 in the reflective mode. A transmissive mode gamma reference voltage generator 1254 outputs a transmissive mode gamma reference voltage 1256 to the data driver 1220 in the transmissive mode. For example, the gamma reference voltage generator 1250 may employ resistor array so as to generate the gamma reference voltage.

The common voltage generator 1240 or the gamma reference voltage generator 1250 may generate a same common voltage or a same gamma reference voltage in both reflective and transmissive modes. In other words, the common voltage generator 1240 may include the reflective mode common voltage generator 1242 and the transmissive mode common voltage generator 1244, but the gamma reference voltage generator 1250 may include only one gamma reference voltage generator regardless of the transmissive or reflective modes. In addition, the common voltage generator 1240 may include only one common voltage generator 1240 regardless of the transmissive or reflective modes, but the gamma reference voltage generator 1250 may include the reflective mode gamma reference voltage generator 1252 and the transmissive mode common gamma reference voltage generator 1254.

When each of the R. G. B. image data may have different V-T and V-R curves, the common voltage generator 1240 and the gamma reference voltage generator 1250 may generate different common voltages and gamma reference voltages, respectively, for each of R. G. B. image data.

Figure 13:
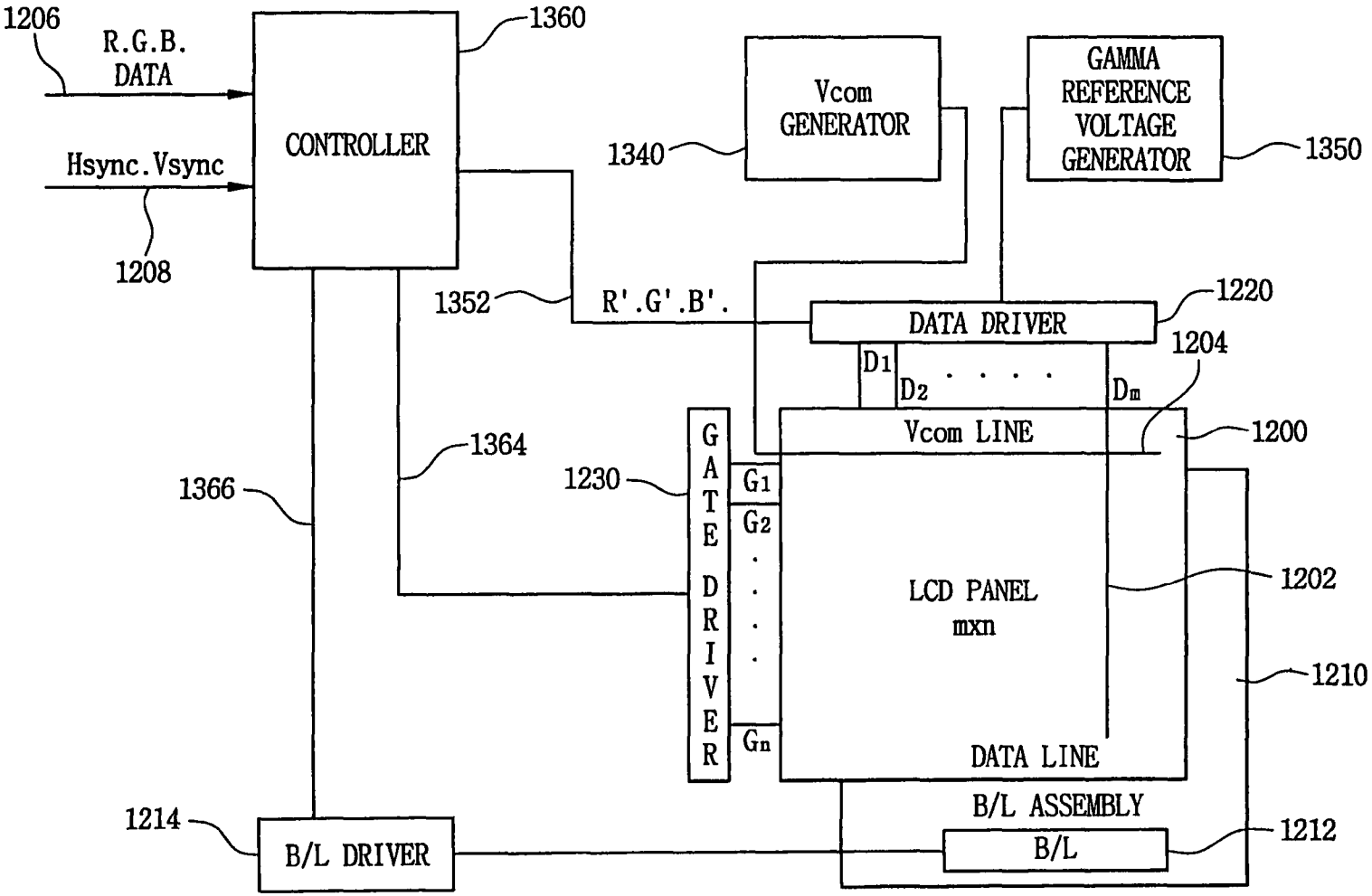
FIG. 13 is a block diagram showing a liquid crystal display device according to a fourth exemplary embodiment of the present invention.
Figure 14:
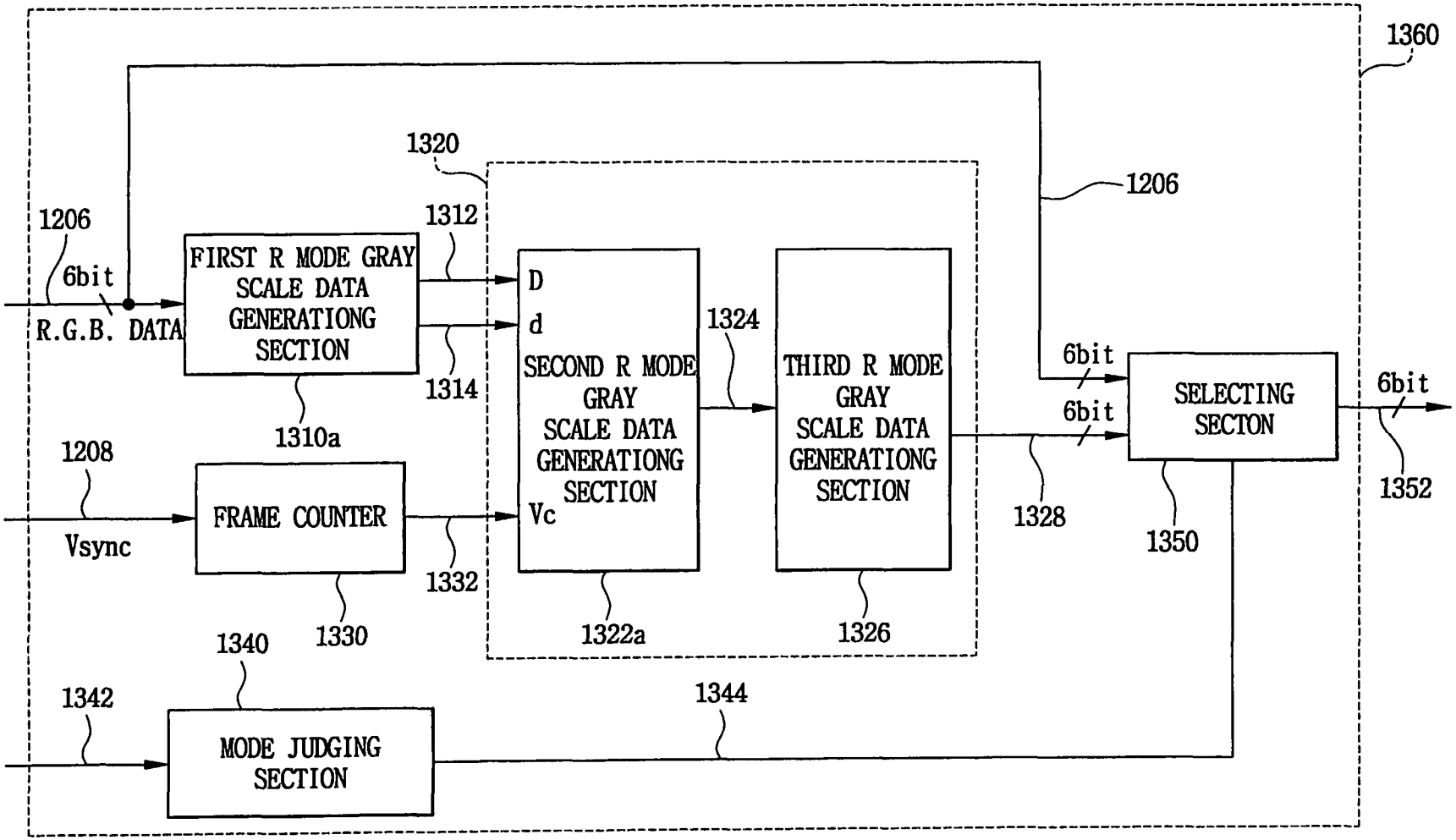
FIG. 14 is a block diagram showing an example of a controller of FIG. 13.
Figure 16:
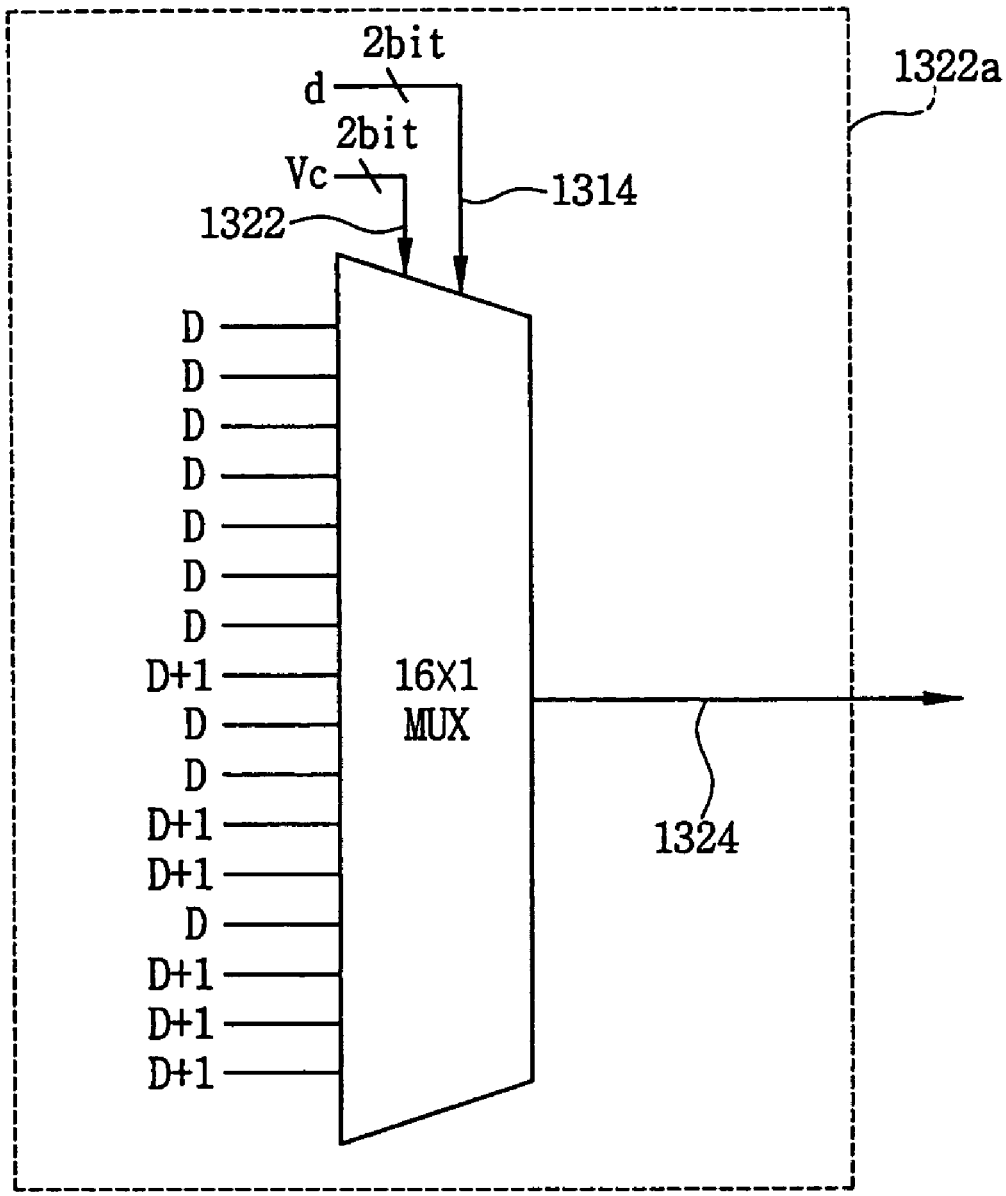
FIG. 16 is block diagram showing an example of a second reflective mode gray scale data generating section of FIG. 14.
Figures 18, 19:
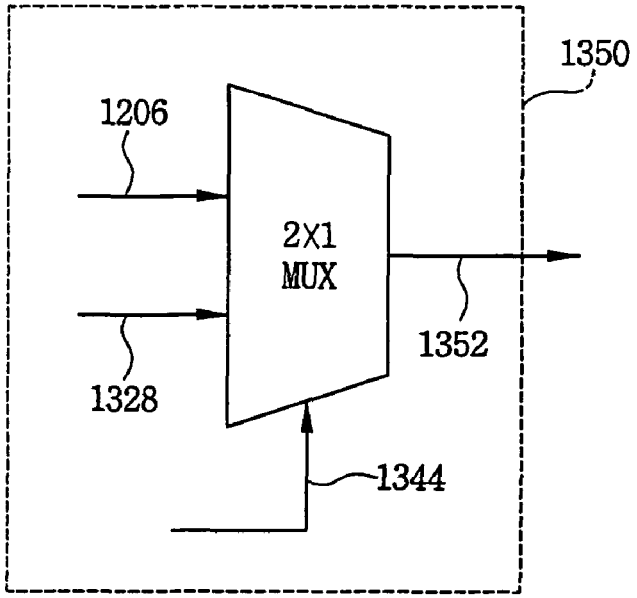
FIG. 18 is a schematic view showing the output of the multiplex of FIG. 17.
FIG. 19 is block diagram showing an example of a selecting section of FIG. 14.

FIG. 13 is a block diagram showing a liquid crystal display device according to a fourth exemplary embodiment of the present invention, FIG. 14 is a block diagram showing an example of a controller of FIG. 13, and FIG. 15 is a table showing a real reflective mode gray scale data produced by a first reflective mode gray scale data generating section. FIG. 16 is block diagram showing an example of a second reflective mode gray scale data generating section of FIG. 14, FIG. 17 is a table showing an output of the multiplex of FIG. 16 depending values of selecting terminal of the multiplex, and FIG. 18 is a schematic view showing the output of the multiplex of FIG. 17.

Referring to FIG. 13, the liquid crystal display device includes a liquid crystal display panel 1200, a backlight assembly 1210, a data driver 1220, a gate driver 1230, a backlight driver 1214, a controller 1360, a common voltage generator 1340 and a gamma reference voltage generator 1350. In FIG. 13, a same common voltage and a same gamma reference voltage is applied to the liquid crystal display panel 1200.

The controller 1360 receives image data (or R.G.B. image data 1206), vertical synchronization signal (Vsync) and horizontal synchronization signal (Hsync) 1208 from an external graphic controller (not shown). For example, the R.G.B. image data 1206 may be transmissive mode gray scale data, each of the R.G.B. image data 1206 may have 6 bits (i.e. 64 levels of gray scale) of digital data, 8 bits (i.e.256 levels of gray scale) of digital data or any other bits of digital data. For example, when the present invention is applied to lap top computer (or notebook computer) and PDA (personal digital assistant) that employ a data driver receiving 6 bits of R'. G'. B'. image data, the controller 1360 may uses 6 bits of R. G. B. image data 1206.

Hereinafter, it is assumed that the R. G. B. image data 1206 have a transmissive mode gray scale data having 64 levels of gray scale, the V-T and V-R curves of the liquid crystal display device is the same as that of FIG. 11, and the common voltage of the common voltage generator 1240 and the gamma reference voltage of the gamma reference voltage generator 1250 is optimized according to the transmissive mode.

When the controller 1360 receives the R. G. B. image data 1206 having 64 levels of gray scale in a transmissive mode, the controller 1360 outputs a transmissive mode gray scale data to the data driver 1220. When the controller 1360 receives the R. G. B. image data 1206 having 64 levels of gray scale in a reflective mode, the controller 1360 transforms the R. G. B. image data 1206 into a real reflective mode gray scale data and a first reflective mode gray scale data based on the characteristics of the V-T and V-R curves of FIG. 11. The controller 1360 generates a second reflective mode gray scale data, and inserts pseudo gray scale data into the second reflective mode gray scale data to produce a third reflective mode gray scale data. An average value of the second reflective mode gray scale data for N frames is substantially the same as the real reflective mode gray scale data.

The common voltage generator 1340 applies a predetermined common voltage to the common line.

The common voltage generator 1340 may employ a high voltage driving method and a low voltage driving method.

The gamma reference voltage generator 1350 generates a gamma reference voltage and outputs the gamma reference voltage to the data driver 1220. For example, the gamma reference voltage generator 1350 may employ resistor array so as to generate the gamma reference voltage.

Referring to FIG. 14, the controller 1360 includes a first reflective mode (R mode) gray scale data generating section 1310*a*, a frame counter 1330, a second reflective mode (R mode) gray scale data generating section 1322*a*, a third reflective mode (R mode) gray scale data generating section 1326, a mode judging section 1342 and a selecting section 1350. The controller 1360 performs the functions of a timing controller (Tcon) of a general liquid crystal display device, only the circuit elements related to the gray scale data generator is shown in FIG. 14, and other circuit elements of the timing controller is not shown in FIG. 14.

When the transmissive mode gray scale data is transformed into a reflective mode gray scale data and the interval between the gray scale levels of the transformed reflective mode gray scale data has a linear property, the first reflective mode gray scale data generating section 1310*a* may be employed. However, the first reflective mode gray scale data generating section 1310*a* may be also employed when the interval between the gray scale levels of the transformed reflective mode gray scale data has a non-linear property. When the interval between the gray scale levels of the transformed reflective mode gray scale data has a non-linear property, a lookup table may be also employed.

The first reflective mode gray scale data generating section 1310*a* receives 6 bits of R.G.B. image data 1206 outputted from an external graphic controller (not shown), and generates a first reflective mode gray scale data (D) 1312 and a control data (d) 1314.

The first reflective mode gray scale data generating section 1310*a* generates a real reflective mode gray scale data corresponding to a first effective range of a reflective mode gray scale voltage using a relationship between a second effective range of a transmissive mode gray scale voltage and the transmissive mode gray scale data. The real reflective mode gray scale data may be a real number that includes figures below a decimal-point. As shown in FIG. 11, when gray scale '0' corresponds to gray scale voltage 1.5 volts and gray scale '63' corresponds to gray scale voltage 4 volts in the transmissive mode, the effective range of reflective mode gray scale voltage is from 0 volt to 3 volts. The effective range of transmissive mode gray scale voltage may be from 1.5 volts to 4 volts, or from about 0 volt to about 4 volts. The effective range of reflective mode gray scale voltage is from 1.5 volts to 3 volts.

For example, when gray scale voltage 3.0 volts corresponds to gray scale '47', the first reflective mode gray scale data generating section 1310*a* transforms the transmissive mode gray scale data of which value is in a range from 0 to 63 into a real reflective mode gray scale data of which value is in a range from 0 to 47.

For example, the transmissive mode gray scale data is transformed into a real reflective mode gray scale data by the following expression 1

$$(Gn(R)=[(Gn(T)\times x\times N)+y]\div N \qquad \text{<Expression 1>}$$

(Gn(R) denotes the real reflective mode gray scale data, Gn(T) denotes the transmissive mode gray scale data, x denotes a positive real number less than 1, y denotes integer as an offset value, and N denotes a positive integer)

When the transmissive mode has gray scale levels in a range from 0 to 63 and the reflective mode has gray scale level in a range from 0 to 47, the 'x' value may be 0.75 (48÷64). In addition, the 'x' value may have (effective range of reflective mode gray scale voltage)÷(effective range of transmissive mode gray scale voltage). The 'y' denotes an offset value for providing a smooth gamma curve in the reflective mode when the transmissive mode gray scale data is transformed into the reflective mode gray scale data. In other words, the 'y' may have an integer value for reducing an error between the effective range of the reflective mode gray scale voltage on the V-R curve and the effective range of the transmissive mode gray scale voltage on the V-T curve.

FIG. 15 is shows the real reflective mode gray scale data (Gn(R)) produced by the expression 1.

Referring to FIG. 15, when the transmissive mode gray scale data of which value is in a range from 0 to 63 are transformed into the real reflective mode gray scale data of which value are in a range from 0 to 47, the real reflective mode gray scale data may have figures below a decimal-point. Namely, a halftone gray scale may be generated. The real reflective mode gray scale data may have 1.5, 5.25, and 5.75 that have figures below a decimal-point such as 0.25, 0.5, and 0.75. The first reflective mode gray scale data generating section 1312 extracts an integer part from the real reflective mode gray scale data to produce the first reflective mode gray scale data (D) 1312, and generates a control datum (d) 1314 corresponding to a figure below a decimal-point of each of the real reflective mode gray scale data. When the figure below the decimal-point is 0, the control datum (d) is 0. When the figure below the decimal-point is 0.25, the control datum (d) is 1. When the figure below the decimal-point is 0.5, the control datum (d) is 2, i.e. a binary value $10_{(2)}$.. When the figure below the decimal-point is 0.75, the control datum (d) is 3, i.e. a binary value $11_{(2)}$. For example, when the real reflective mode gray scale data have 2.25, the first reflective mode gray scale data (D) is 2 and the control datum (d) is 1.

Referring again to FIG. 14, the frame counter 1330 receives the vertical synchronization signal (Vsync), counts the number of the frame synchronization signal or the number of the frames and outputs a frame count value (Vc).

The second reflective mode gray scale data generating section 1322 generates a mixed sequence of gray scale data in which the first reflective mode gray scale data (D) 1312 and temporary reflective mode gray scale data are arranged in a predetermined ratio by N-frame period and produce second reflective mode gray scale data. The temporary reflective mode gray scale data may be (D+n) (n is an integer, for example n is 1).

The second reflective mode gray scale data generating section 1322 treats the halftone gray scale using the vertical synchronization signal (Vsync) such that an average value of the second reflective mode gray scale data for N frames is substantially the same as the real reflective mode gray scale data. For example the N may be 4. Hereinafter, it is assumed that the N is 4.

Particularly, the second reflective mode gray scale data generating section 1322 receives the first reflective mode gray scale data (D) 1312 and the control data (d) 1314 outputted from the first reflective mode gray scale data generating section 1310*a*. The control data (d) 1314 has binary value. The second reflective mode gray scale data generating section 1322 receives the frame count value (Vc) 1332 outputted from the frame counter 1330.

For example, the second reflective mode gray scale data generating section 1322 may include a multiplexer.

Referring to FIG. 16, the second reflective mode gray scale data generating section 1322 includes 16×1 multiplexer (MUX). The 16×1 multiplexer (MUX) receives the first reflective mode gray scale data (D) 1312 or the temporary reflective mode gray scale data (D+1) through input terminals. The 16×1 multiplexer (MUX) receives the control data (d) 1314 of which upper bits corresponds to the frame count value (Vc) 1332 and of which lower bits corresponds to the control data (d) 1314 through the selecting terminal. As shown in FIG. 17, the 16×1 multiplexer (MUX) outputs the second reflective mode gray scale data 1324. For example the frame count value (Vc) may have 2-bit width data, and the control data (d) 1314 may have 2-bit width data.

Referring to FIG. 18, the second reflective mode gray scale data 1324 for 4 frames are shown. When the control data (d) is 0, i.e. the figure below the decimal-point of the real reflective mode gray scale data is 0, the temporary gray scale datum having a value of D+1 is not shown for 4 frames.

When the control data (d) is 1, i.e. the figure below the decimal-point of the real reflective mode gray scale data is 0.25, one temporary gray scale datum having a value of D+1 is shown. For example, when the real reflective mode gray scale data is 2.25, the D is 2 and d is 1. An average value of three Ds and one D+1 for 4 frames is the same as the real reflective mode gray scale data 2.25.

When the control data (d) is 2, i.e. the figure below the decimal-point of the real reflective mode gray scale data is 0.5, two temporary gray scale data having a value of D+1 are shown. For example, when the real reflective mode gray scale data is 2.5, the D is 2 and d is 2. An average value of two Ds and two (D+1)s for 4 frames is the same as the real reflective mode gray scale data 2.5.

When the control data (d) is 3, i.e. the figure below the decimal-point of the real reflective mode gray scale data is 0.75, three temporary gray scale data having a value of D+1 are shown. For example, when the real reflective mode gray scale data is 2.75, the D is 2 and d is 3. An average value of one D and three (D+1)s for 4 frames is the same as the real reflective mode gray scale data 2.75. Since, the average value of the second reflective mode gray scale data for N frames is substantially the same as the real reflective mode gray scale data, the real reflective mode gray scale data that have figures below the decimal-point is able to be restored by means of the second reflective mode gray scale data and the temporary reflective mode gray scale data.

A frame rate control (FRC) method may be used so as to restore the real reflective mode gray scale data. In the FRC method, the number of ON frames of dot (or pixel) to be displayed in N-frame period is changed depending on the control data (d). In other words, in the FRC method, the ratio of a first number of ON frames of dot and a second number of OFF frames of dot in N-frames period determines the halftone gray scale data. Accordingly, the halftone gray scale data is restored. In the FRC method, a FRC pattern varies in every frame period. The FRC pattern includes the first number of ON frames of dot and the second number of OFF frames of dot.

Referring again to FIG. 14, the third reflective mode gray scale data generating section 1326 inserts pseudo gray scale data into the second reflective mode gray scale data 1324 to produce a third reflective mode gray scale data 1328. The number of the pseudo gray scale data is the difference between the number of the transmissive mode gray scale level and the number of the reflective mode gray scale level. For example, when the number of the transmissive mode gray scale is 64 and the number of the reflective mode gray scale is 48, 16 pseudo gray scale data are inserted into the second reflective mode gray scale data 1324, and 64 third reflective mode gray scale data 1328. Accordingly, the third reflective mode gray scale data 1328 has the same bits and gray scale levels as that of the transmissive mode gray scale data.

The mode judging section determines one of a transmissive mode or a reflective mode to output a mode determining signal. For example, when the backlight is turned on, the mode judging section outputs the mode determining signal that represents the transmissive mode. When the backlight is turned off, the mode judging section outputs the mode determining signal that represents the reflective mode.

The selecting section 1350 provides the transmissive and reflective type liquid crystal display device with the transmissive mode gray scale data corresponding to the transmissive mode gray scale data when the mode determining signal represents the transmissive mode and providing the transmissive and reflective type liquid crystal display device with a reflective mode gray scale data corresponding to the third reflective mode gray scale data when the mode determining signal represents the reflective mode. For example, the selecting section 1350 may employ 2×1 MUX.

FIG. 19 is block diagram showing an example of a selecting section of FIG. 14.

Referring to FIG. 19, the 2×1 MUX receives the mode determining signal 1344 through a selecting terminal, and receives the transmissive mode gray scale data 1206 and the third reflective mode gray scale data 1328 through input terminals. The 2×1 MUX outputs transmissive mode gray scale data 1206 and the third reflective mode gray scale data 1328 according to the mode determining signal 1344.

Figure 20:
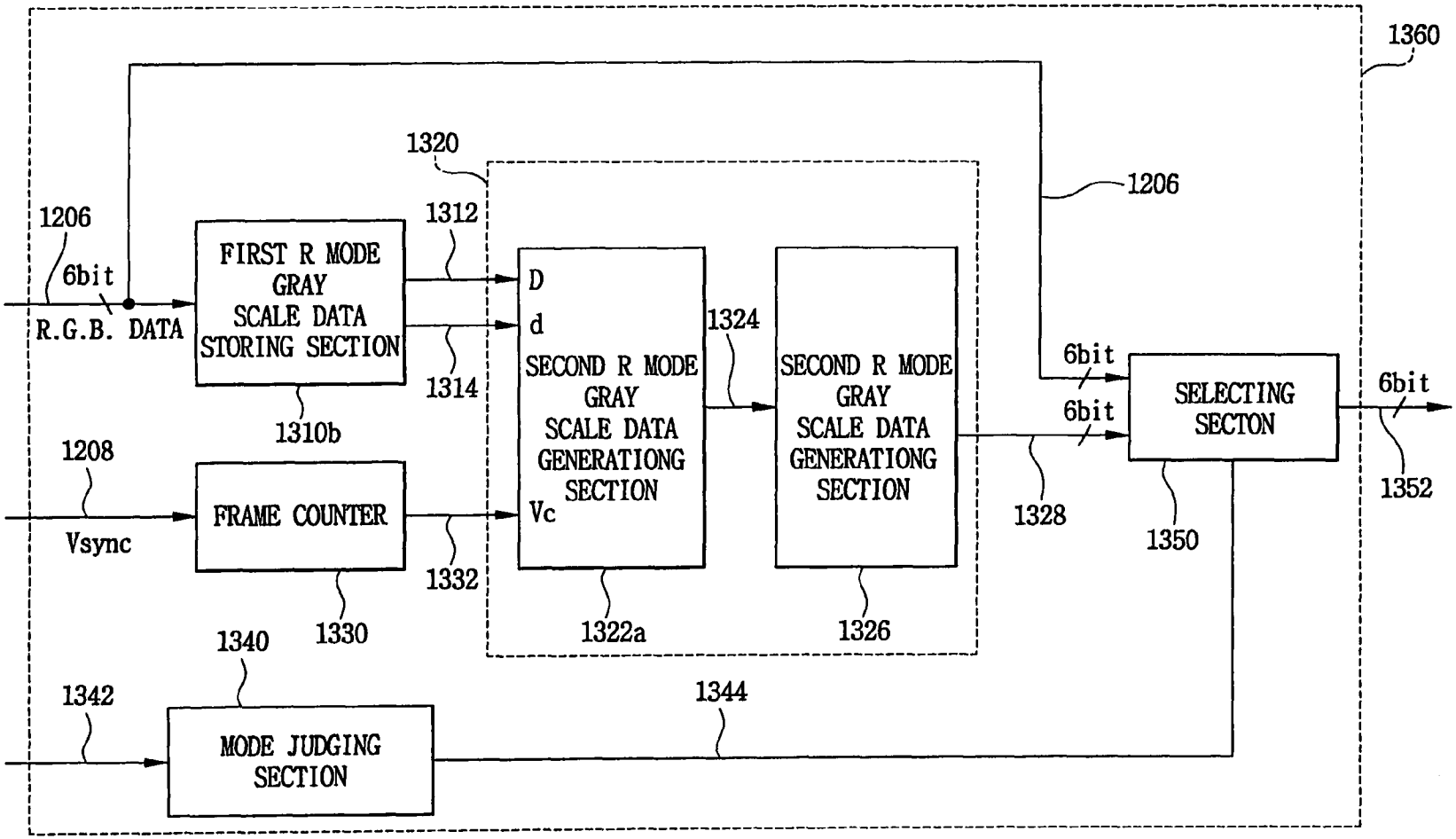
FIG. 20 is a block diagram showing another example of the controller of FIG. 13.

FIG. 20 is a block diagram showing another example of the controller of FIG. 13, and FIG. 21 is a table showing a first reflective mode gray scale data stored in a first reflective mode gray scale data storing section.

Referring to FIG. 20, the controller 1360 includes a first reflective mode (R mode) gray scale data storing section 1310*b*, a frame counter 1330, a second reflective mode (R mode) gray scale data generating section 1322*b*, a third reflective mode (R mode) gray scale data generating section 1326, a mode judging section 1342 and a selecting section 1350. The controller 1360 has the same structure as the controller of FIG. 14 except the first reflective mode (R mode) gray scale data storing section 1310*b*

When transmissive mode gray scale data is transformed into reflective mode gray scale data and the interval between the gray scale levels of the transformed reflective mode gray scale data has a non-linear property, the first reflective mode gray scale data storing section 1310*b* may be employed. The first reflective mode gray scale data storing section 1310*b* stores the real reflective mode gray scale data of which value has non-linear property. However, the first reflective mode gray scale data storing section 1310*b* may be also employed when the interval between the gray scale levels of the transformed reflective mode gray scale data has a linear property.

The first reflective mode gray scale data storing section 1310*b* receives 6 bits of R.G.B. image data 1206 outputted from an external graphic controller (not shown), and stores a real reflective mode gray scale data, a first reflective mode gray scale data (D) 1312 and a control data (d) 1314.

The first reflective mode gray scale data storing section 1310*b* is referred to as a lookup table. The first reflective mode gray scale data storing section 1310*b* stores the real reflective mode gray scale data corresponding to a first effective range of the reflective mode gray scale voltage using a relationship between a second effective range of the transmissive mode gray scale voltage and the transmissive mode gray scale data. As shown in FIG. 11, when gray scale '0' corresponds to gray scale voltage 1.5 volts and gray scale '63' corresponds to gray scale voltage 4 volts in the transmissive mode, the effective range of reflective mode gray scale voltage is from 0 volt to 3 volts.

For example, when gray scale voltage 3.0 volts corresponds to gray scale '47', the first reflective mode gray scale data storing section 1310*b* transforms the transmissive mode gray scale data of which value is in a range from 0 to 63 into a real reflective mode gray scale data of which value is in a range from 0 to 47.

For example, the first reflective mode gray scale data storing section 1310*b* may stores the real reflective mode gray scale data shown in FIG. 21.

Referring to FIG. 21, when the transmissive mode gray scale data of which value is in a range from 0 to 63 are transformed into the real reflective mode gray scale data of which value are in a range from 0 to 47, the real reflective mode gray scale data may have figures below a decimal-point. Namely, a halftone gray scale may be generated. For example, the real reflective mode gray scale data may have 1.43, 2.76, and 4.33 that have figures below a decimal-point such as 0.43, 076, and 0.33. The first reflective mode gray scale data storing section 1310*b* stores the control data (d) 1314. The figures below a decimal-point such as 0.43, 076, and 0.33 is transformed into limited number of figures below a decimal-point such as 0.25, 0.5, and 0.75. The control data (d) 1314 has the limited number of figures below a decimal-point such as 0.25, 0.5, and 0.75. For example, the control data (d) has 0.5 when the figure below a decimal-point is 0.43, the control data (d) has 0.75 when the figure below a decimal-point is 0.76.

The first reflective mode gray scale data (D) 1312 has the integer part of the real reflective mode gray scale data.

When the transformed figure below a decimal-point is 0, d is 0. When the transformed figure below a decimal-point is 0.25, d is 1. When the transformed figure below a decimal-point is 0.5, d is 2 (i.e. a binary value $10_{(2)}$). When the transformed figure below a decimal-point is 0.75, d is 3(i.e. a binary value $10_{(2)}$).

For example, when the real reflective mode gray scale data is 1.43, D is 1 and d is 2. For example, when the real reflective mode gray scale data is 2.76, D is 2 and d is 3.

Referring again to FIG. 21, the frame counter 1330 receives the vertical synchronization signal (Vsync), counts the number of the frame synchronization signal or the number of the frames and outputs a frame count value (Vc). For example, the frame count value (Vc) may be 2-bit width data.

The second reflective mode gray scale data generating section 1322*b* generates a mixed sequence of gray scale data in which the first reflective mode gray scale data (D) 1312 and temporary reflective mode gray scale data are arranged in a predetermined ratio by N-frame period and produce second reflective is mode gray scale data. The temporary reflective mode gray scale data may be (D+n) (n is an integer, for example n is 1). For example the N may be 4. Hereinafter, it is assumed that the N is 4. The second reflective mode gray scale data generating section 1322*b* treats the halftone gray scale using the vertical synchronization signal (Vsync) such that an average value of the second reflective mode gray scale data for N frames is substantially the same as the real reflective mode gray scale data.

Particularly, the second reflective mode gray scale data generating section 1322*b* receives the first reflective mode gray scale data (D) 1312 and the control data (d) 1314 outputted from the first reflective mode gray scale data storing section 1310*b*. The second reflective mode gray scale data generating section 1322*b* receives the frame count value (Vc) 1332 outputted from the frame counter 1330.

For example, the second reflective mode gray scale data generating section 1322*b* may include a multiplexer.

As mentioned above, the frame rate control (FRC) method may be used so as to restore the real reflective mode gray scale data.

The third reflective mode gray scale data generating section 1326 inserts pseudo gray scale data into the second reflective mode gray scale data 1324 to produce a third reflective mode gray scale data 1328. The number of the pseudo gray scale data is the difference between the number of the transmissive mode gray scale level and the number of the reflective mode gray scale level.

The mode judging section 1340 determines one of a transmissive mode or a reflective mode to output a mode determining signal. For example, when the backlight is turned on, the mode judging section outputs the mode determining signal that represents the transmissive mode. When the backlight is turned off, the mode judging section outputs the mode determining signal that represents the reflective mode.

The selecting section 1350 provides the transmissive and reflective type liquid crystal display device with the transmissive mode gray scale data corresponding to the transmissive mode gray scale data when the mode determining signal represents the transmissive mode, and providing the transmissive and reflective type liquid crystal display device with a reflective mode gray scale data corresponding to the third reflective mode gray scale data when the mode determining signal represents the reflective mode. For example, the selecting section 1350 may employ 2×1 MUX.

Figure 22:
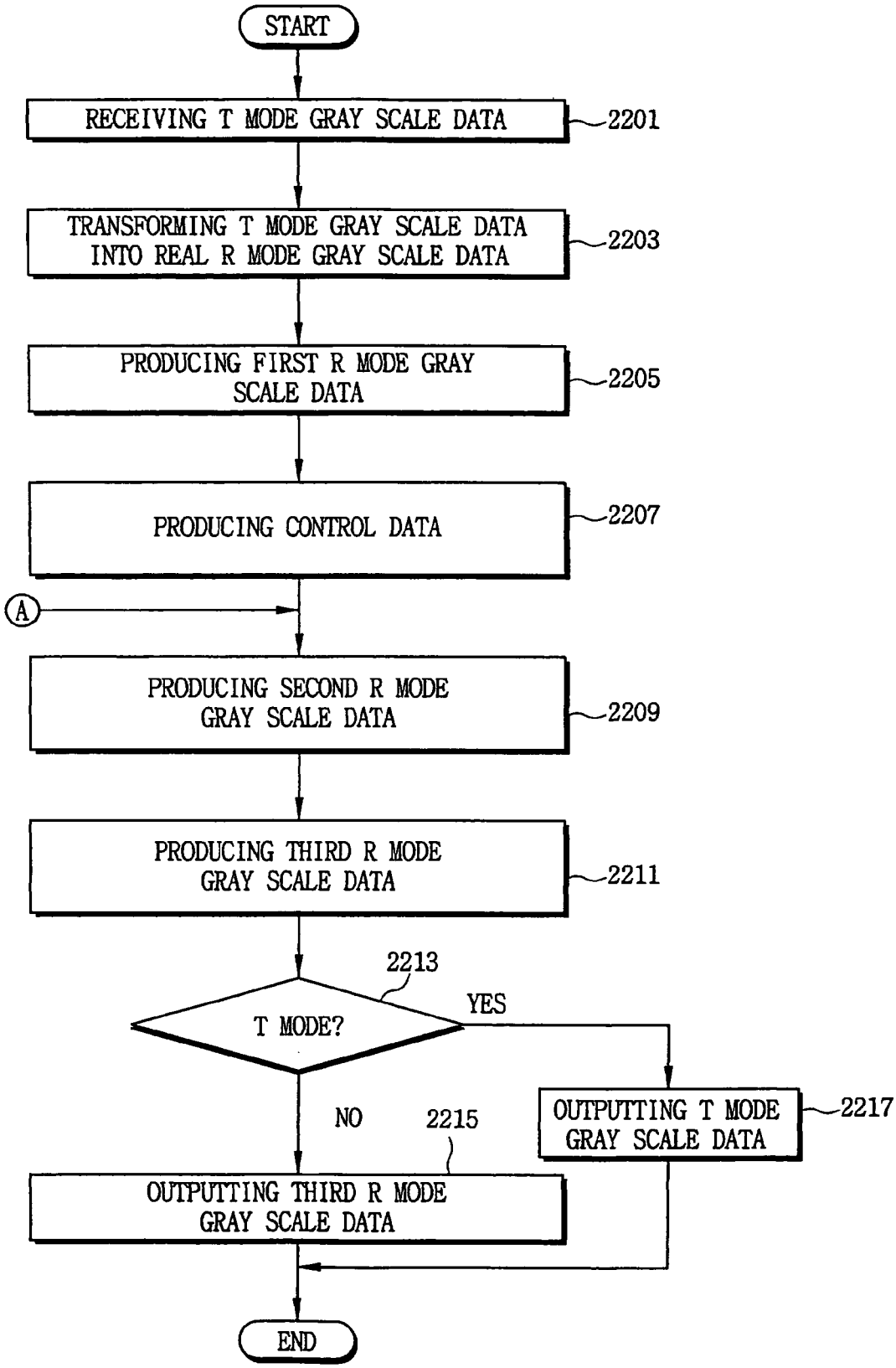
FIG. 22 is a flow chart showing a method of producing gray scale data according to a fifth exemplary embodiment of the present invention.

FIG. 22 is a flow chart showing a method of producing gray scale data according to a fifth exemplary embodiment of the present invention.

Referring to FIG. 22, transmissive mode gray scale data is received (step 2201). The transmissive mode gray scale data is transformed into real reflective mode gray scale data (step 2203). Particularly, the real reflective mode gray scale data corresponding to a first effective range of a reflective mode gray scale voltage is produced using the relation between a second effective range of a transmissive mode gray scale voltage and the transmissive mode gray scale data.

An integer part is extracted from the real reflective mode gray scale data so as to produce first reflective mode gray scale data (step 2205).

Figures below a decimal point of the real reflective mode gray scale data are extracted so as to produce a control data (d) (step 2207).

Second reflective mode gray scale data is produced (step 2209). The first reflective mode gray scale data (D) and temporary reflective mode gray scale data (D+n) are arranged in a predetermined ratio by N-frame period. For example, the temporary reflective mode gray scale data may be D+1.

Pseudo gray scale data are inserted into the second reflective mode gray scale data so as to produce third reflective mode gray scale data (step 2211). The number of the pseudo gray scale data is a difference between the number of a transmissive mode gray scale level and the number of a reflective mode gray scale level.

After determining the mode is transmissive mode (step 2213), a reflective mode gray scale voltage corresponding to the reflective mode gray scale data is outputted to the transmissive and reflective type liquid crystal display device when the transmissive and reflective type liquid crystal display device operates in the reflective mode (step 2215). A transmissive mode gray scale voltage corresponding to the transmissive mode gray scale data is outputted to the transmissive and reflective type liquid crystal display device when the transmissive and reflective type liquid crystal display device operates in the transmissive mode (step 2217).

Figure 23:
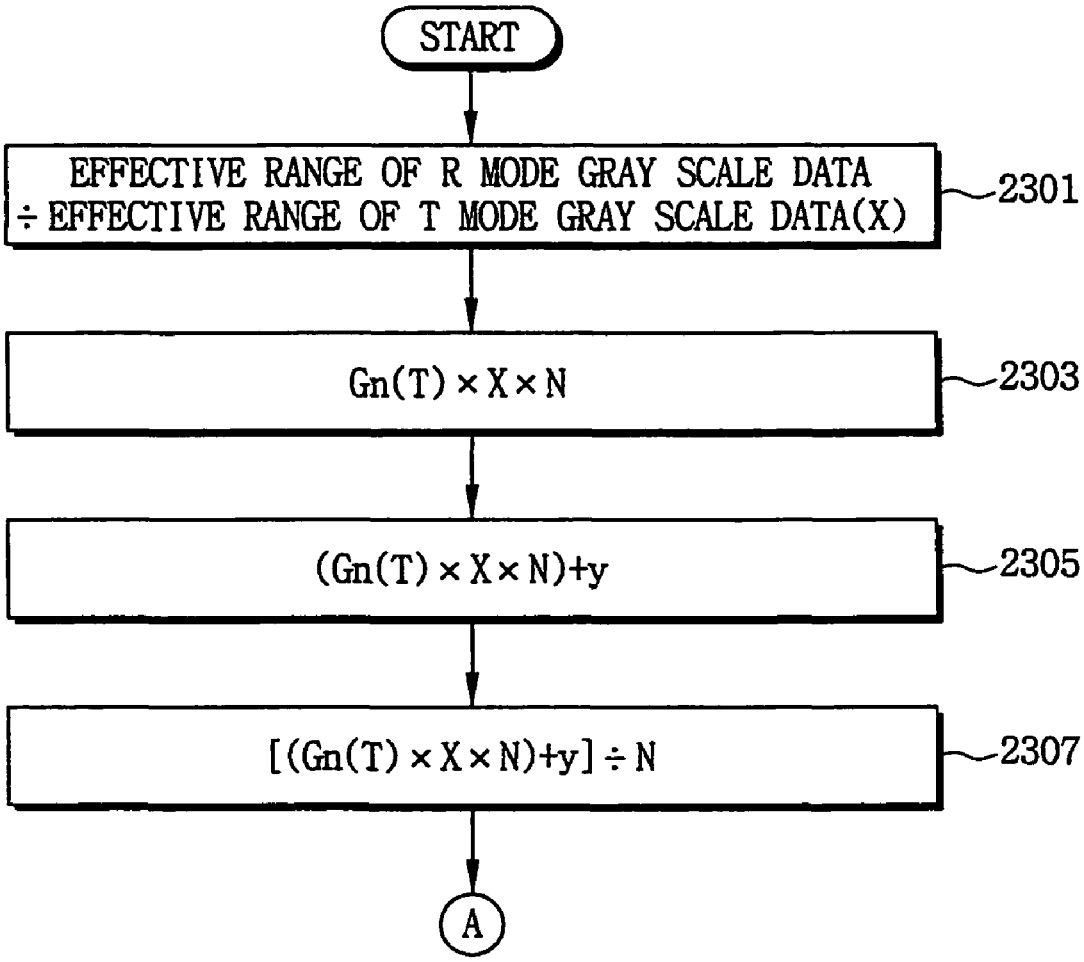
FIG. 23 is a flow chart showing a method of producing a reflective mode gray scale data of FIG. 22.

FIG. 23 is a flow chart showing a method of producing a reflective mode gray scale data of FIG. 22 by means of the expression 1.

Referring to FIG. 23, a ratio (x) (effective range of reflective mode gray scale voltage)÷(effective range of transmissive mode gray scale voltage) is produced (step 2301). The transmissive mode gray scale data Gn(T) is multiplied by the ratio (x) and the N (step 2303), and then an offset (y) is added the result of step 2303 (step 2305). The result of step 2305 is divided by the N so as to produce the first reflective mode gray scale data (step 2307), and returns back to the step 2209.

For example, the gray scale voltage generator, method of generating the gray scale voltage and the transmissive and reflective type liquid crystal display device according to the present invention may be applied to mobile devices that have a screen size less than 2 inches. In addition, the gray scale voltage generator may be applied to a lap top computer (or notebook), PDA, etc.

While the exemplary embodiments of the present invention and its advantages have been described in detail, it should be understood that various changes, substitutions and alterations can be made herein without departing from the spirit and scope of the invention as defined by appended claims.

What is claimed is:

1. A liquid crystal display device comprising:

a first insulation substrate;

a first wiring formed on the first insulation substrate and extended in a first direction;

a second wiring formed on the first insulation substrate and intersecting the first wiring;

a transparent electrode formed in at least one pixel region;

a reflective electrode on the transparent electrode in the at least one pixel region and having an opening;

a first thin film transistor substrate connected to the first wiring, the second wiring, the transparent electrode and the reflective electrode;

a second insulation substrate facing the first insulation substrate;

a common electrode formed on the second insulation substrate; and a liquid crystal layer interposed between the first and second insulation substrate and including a liquid crystal molecule and a chiral dopant, wherein a major axis of the liquid crystal molecule is vertically aligned to the first and second insulation substrates, a ratio of a cell gap to a pitch of the liquid crystal layer is in a range from 0 to 0.15, twist angles of the liquid crystal molecules are in a range from about 0° to about 50°, when electric field is applied to the liquid crystal layer, and a Δnd of the liquid crystal layer is in a range from about 0.15 to about 0.35, Δ n is a refraction index change of the liquid crystal layer, and d is a cell gap.

2. The liquid crystal display device of claim 1, wherein the liquid crystal display device further comprising a first λ/4 retardation film disposed on an outer surface of the first insulation substrate and a second λ/4 retardation film disposed on an outer surface of the second insulation substrate.

3. The liquid crystal display device of claim 1, wherein the liquid crystal display device further comprising a first Δ/2 retardation film disposed on an outer surface of the first insulation substrate and a second Δ/2 retardation film disposed on an outer surface of the second insulation substrate.

4. The liquid crystal display device of claim 2, wherein each of the first and second Δ/2 retardation film includes a reciprocal dispersion retardation film.

5. The liquid crystal display device of claim 2, wherein the liquid crystal display device further comprising:

a light source, disposed below the first insulation substrate, for being turned off in a reflective mode and being turned on in a transmissive mode;

a data driver for applying a gray scale voltage to the thin film transistor in the pixel region; and a gray scale voltage generator for generating a gray scale voltage using an external image signal and a control signal, the gray scale voltage generator generating a reflective mode gray scale voltage in a reflective mode and a transmissive mode gray scale voltage in a transmissive mode.

6. The liquid crystal display device of claim 5, wherein the gray scale voltage generator comprising:

a controlling means for providing the liquid crystal display device with a transmissive mode gray scale data when the light source is turned on, and for providing the liquid crystal display device with a reflective mode gray scale data when the light source is turned off;

a gamma reference voltage generating means for generating a transmissive mode gamma reference voltage corresponding to the transmissive mode gray scale data and a reflective mode gamma reference voltage corresponding to the reflective mode gray scale data and outputting the transmissive and reflective mode gamma reference voltages to the data driver; and a common voltage generating means for generating a common voltage to output the common voltage to a common line connected to the common electrode in the pixel region, the common voltage having a transmissive mode common voltage corresponding to a transmissive mode and a reflective mode common voltage corresponding to a reflective mode.

7. The liquid crystal display device of claim 6, wherein the gray scale voltage generator includes a first gamma reference resistance used in the reflective mode and a second gamma reference resistance used in the transmissive mode, the first gamma reference resistance different from the second gamma reference resistance.

8. The liquid crystal display device of claim 5, wherein the gray scale voltage generator comprising:

a controlling means for providing the liquid crystal display device with a transmissive mode gray scale data when the light source is turned on, and for providing the liquid crystal display device with a reflective mode gray scale data when the light source is turned off;

a gamma reference voltage generating means for generating a gamma reference voltage to output the gamma reference voltage to the data driver; and a common voltage generating means for generating a common voltage to output the common voltage to a common line connected to the common electrode in the pixel region.

9. The liquid crystal display device of claim 8, wherein the controlling means comprising:

a first reflective mode gray scale data generating means receiving transmissive mode gray scale data, producing real reflective mode gray scale data corresponding to a first effective range of a reflective mode gray scale voltage using a relation between a second effective range of a transmissive mode gray scale voltage and the transmissive mode gray scale data, extracting an integer part from the real reflective mode gray scale data to produce first reflective mode gray scale data, and generating a control datum corresponding to a first figure below a decimal-point of each of the real reflective mode gray scale data;

a frame counter receiving a frame synchronization signal indicating a beginning of each of the N frames and counting a number of the frame synchronization signal to produce a frame count value;

a second reflective mode gray scale data generating means mixing the first reflective mode gray scale data and temporary reflective mode gray scale data in a predetermined ratio by N-frame period to produce second reflective mode gray scale data, the temporary reflective mode gray scale data being a sum of a first integer and the first reflective mode gray scale data;

a third reflective mode gray scale data generating means inserting pseudo gray scale data into the second reflective mode gray scale data to produce a third reflective mode gray scale data, a first number of the pseudo gray scale data being a difference between a second number of a transmissive mode gray scale level and a third number of a reflective mode gray scale level;

a mode judging means for determining one of a transmissive mode or a reflective mode to output a mode determining signal; and a selecting means providing the transmissive and reflective type liquid crystal display device with a transmissive mode gray scale data corresponding to the transmissive mode gray scale data when the mode determining signal represents the transmissive mode and providing the transmissive and reflective type liquid crystal display device with a reflective mode gray scale data corresponding to the third reflective mode gray scale data when the mode determining signal represents the reflective mode.

10. The liquid crystal display device of claim 9, wherein the real reflective mode gray scale data satisfies the relationship of $[(Gn(T)\times x\times N)+y]\div N$, wherein Gn(T) denotes the transmissive mode gray scale data, x denotes a positive real number less than 1, y denotes a second integer, respectively.

11. The liquid crystal display device of claim 5, wherein the gray scale voltage generator transforming the transmissive mode gray scale data having m1 bits into a first reflective mode gray scale data having m2 bits, m1 and m2 being natural numbers, m2 being less than m1, and producing the second reflective mode gray scale data by a frame rate control method, an average value of the second reflective mode gray scale data for N frames being substantially a same as the real reflective mode gray scale data for the N frames.

12. A liquid crystal display device comprising:

a first insulation substrate;

a first wiring formed on the first insulation substrate and extended in a first direction;

a second wiring formed on the first insulation substrate and intersecting the first wiring;

a transparent electrode formed in at least one pixel region;

a reflective electrode on the transparent electrode in the at least one pixel region;

a first thin film transistor substrate connected to the first wiring, the second wiring, the transparent electrode and the reflective electrode;

a second insulation substrate facing the first insulation substrate;

a common electrode formed on the second insulation substrate; and a liquid crystal layer interposed between the first and second insulation substrate and including a plurality of liquid crystal molecules and a chiral dopant, wherein major axes of the liquid crystal molecules are vertically aligned to the first and second insulation substrates, a ratio of a cell gap to a pitch of the liquid crystal layer is in a range from 0 to 0.15, twist angles of the liquid crystal molecules are in a range from about 0°to about 50°, when electric field is applied to the liquid crystal layer, and a Δnd of the liquid crystal layer is in a range from about 0.15 to about 0.35, Δ n is a refractionrefiactio index change of the liquid crystal layer, and d is a cell gap.

* * * * *